US012264428B2

(12) United States Patent
Shafer

(10) Patent No.: US 12,264,428 B2
(45) Date of Patent: Apr. 1, 2025

(54) MODULAR CHEMICAL DISPENSER AND PUMP FOR SAME

(71) Applicant: Delaware Capital Formation, Inc., Wilmington, DE (US)

(72) Inventor: Glen Shafer, Amelia, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 493 days.

(21) Appl. No.: 17/619,294

(22) PCT Filed: Jun. 23, 2020

(86) PCT No.: PCT/US2020/039049
§ 371 (c)(1),
(2) Date: Dec. 15, 2021

(87) PCT Pub. No.: WO2020/263771
PCT Pub. Date: Dec. 30, 2020

(65) Prior Publication Data

US 2022/0298709 A1 Sep. 22, 2022

Related U.S. Application Data

(60) Provisional application No. 62/865,461, filed on Jun. 24, 2019.

(51) Int. Cl.
*D06F 39/02* (2006.01)
*A47L 15/44* (2006.01)
(Continued)

(52) U.S. Cl.
CPC ..... *D06F 39/022* (2013.01); *A47L 15/4418* (2013.01); *A47L 15/4463* (2013.01);
(Continued)

(58) Field of Classification Search
None
See application file for complete search history.

(56) References Cited

U.S. PATENT DOCUMENTS 5,397,144 A 3/1995 Mirand et al.
6,592,339 B1 7/2003 Fukushima et al.
(Continued)

FOREIGN PATENT DOCUMENTS

EP 0295123 A2 12/1988
EP 0787849 A1 8/1997
(Continued)

OTHER PUBLICATIONS

The International Bureau of WIPO, International Preliminary Report on Patentability in PCT Application No. PCT/US2020/039049, Dec. 28, 2021.
European Patent Office, International Search Report and Written Opinion in PCT Application No. PCT/US2020/039049, Dec. 14, 2020.

*Primary Examiner* — Cristi J Tate-Sims
(74) *Attorney, Agent, or Firm* — Fish & Richardson P.C.

(57) ABSTRACT

A chemical dispenser (14) includes a housing (40), a controller (34) disposed in the housing (40) for operating the chemical dispenser (14), at least one module bay (64) in the housing (40) and at least one module (66) selectively coupled to the at least one module bay (64) and operatively coupled to the controller (34) for operation with the chemical dispenser (14). The at least one module (66) may be selected from a plurality of modules each capable of being coupled to the at least one module bay (64) and operating under the control of the controller (34). A low-maintenance piston pump module (90, 240, 340) for use with the chemical dispenser (14) is also disclosed.

20 Claims, 34 Drawing Sheets

(51) Int. Cl.

| | |
|---|---|
| ***A47L 15/46*** | (2006.01) |
| ***F04B 41/06*** | (2006.01) |
| ***F04B 53/10*** | (2006.01) |
| *D06F 105/42* | (2020.01) |
| *D06F 105/60* | (2020.01) |

(52) U.S. Cl.
CPC ..... *A47L 15/46* (2013.01); *F04B 41/06* (2013.01); *F04B 53/10* (2013.01); *A47L 2501/07* (2013.01); *A47L 2501/26* (2013.01); *D06F 2105/42* (2020.02); *D06F 2105/60* (2020.02)

(56) References Cited

U.S. PATENT DOCUMENTS

| | | | | |
|---|---|---|---|---|
| 2010/0018991 | A1* | 1/2010 | Walker | D06F 39/022 222/255 |
| 2013/0092704 | A1* | 4/2013 | Tincher | F04B 49/065 417/474 |

FOREIGN PATENT DOCUMENTS

| | | | |
|---|---|---|---|
| EP | 2581486 | A2 | 4/2013 |
| WO | 2006094219 | A2 | 9/2006 |
| WO | 2010006761 | A2 | 1/2010 |

* cited by examiner

MODULAR CHEMICAL DISPENSER AND PUMP FOR SAME

TECHNICAL FIELD

This invention generally relates to an improved chemical dispenser for a chemical dispensing system, and more particularly to a chemical dispenser having a modular design and an improved pump for the modular chemical dispenser.

BACKGROUND

The dispensing of liquid chemical products from one or more chemical receptacles is a common requirement of many industries, such as the laundry, textile, warewash, healthcare, and food processing industries. In an industrial laundry facility, for example, one of several operating washing machines will require, from time to time, aqueous solutions containing quantities of alkaloid, detergent, bleach, starch, softener and/or sour. By way of further example, in industrial warewash applications, washing machines will require quantities of detergent, rinse aid, and/or sanitizer. Increasingly, such industries have turned to automated methods and systems for dispensing chemical products.

Contemporary automatic chemical dispensing systems used in the commercial washing industry typically rely on pumps to deliver liquid chemical products from bulk storage containers. Generally, these pumps deliver raw product to a washing machine either directly or via a flush manifold, where the product is mixed with a diluent, such as water, that delivers the chemical product to the machine. A typical chemical dispensing system used to supply a washing machine will include a controller that is coupled to one or more peristaltic pumps in a dispenser by a plurality of dedicated signal lines. The controller will also typically be coupled to a washing machine interface by another plurality of dedicated signal lines, so that the controller is provided with signals indicating the operational state of the machine. In operation, the machine interface transforms high voltage trigger signals generated by the washing machine into lower voltage signals suitable for the controller, and transmits these low voltage trigger signals to the controller over the set of dedicated signal lines, which are typically in the form of a multi-conductor cable. In response to these individual trigger signals, the controller will individually activate one or more of the pumps in the dispenser over another set of dedicated lines so that the pumps dispense a desired amount of a chemical product into the washing machine or into the flush manifold, where the chemicals are then mixed with a diluent before being delivered to the machine.

Chemical dispensing systems employed with commercial washing machines typically utilize peristaltic pumps to minimize both operator and system component contact with the chemical products, which are often corrosive and toxic. Peristaltic pumps of this type include a flexible tube (or squeeze tube) and a rotor with one or more rollers located in a pump chamber. The one or more rollers compress a section of the squeeze tube against a wall of a pump chamber, pinching off the section of squeeze tube. When the rotor is rotated, the location of the pinched section of the squeeze tube moves along the length of the tube, thereby forcing, or pumping, fluid through the tube. While peristaltic pumps operate for their intended purpose, there are some drawbacks to current chemical dispensers employing peristaltic pumps.

By way of example, chemical dispensers with peristaltic pumps generally require regular maintenance to ensure proper operation of the chemical dispensing system. In this regard, the squeeze tubes used in such pumps are subject to wear over time from the repeated compression and pulling from the rollers, which causes the volume of chemical pumped by the dispenser to vary over time. Worn out squeeze tubes must be regularly replaced to prevent tube failure. Moreover, squeeze tube replacement can be a cumbersome endeavor, as chemical product often leaks from the feed lines when the seal is broken between the squeeze tube and feeder tubes. In addition to causing a loss of product and undesirably exposing workers to potentially hazardous chemicals, the spilled product may also contaminate the surfaces of the squeeze tube and pump chamber. If the chemical product is not sufficiently cleaned from these surfaces, the resulting sticky residue can cause the roller to pull the squeeze tube through the pump chamber so that the tube becomes damaged or tangled, resulting in pump failure and further potential product spills. In addition, because the controller cannot determine that the pump is not dispensing the correct amount of product, any processed wash loads that rely on the failed pump will have to be re-processed. Further, because the timing of the pump failure may be difficult to determine, multiple wash loads may have to be reprocessed.

In addition to the above, current chemical dispensers typically have the pumps integrated into the chemical dispenser housing. Thus, while different types of pumps may be available and preferred, depending on the chemical product being dispensed, the use of alternative pumps require a wholesale replacement of the chemical dispenser. More particularly, the chemical dispenser may have to be specifically designed to include different types of pumps for different applications and chemical products. Such an approach to designing an optimal chemical dispensing system is cost prohibitive.

Therefore, there is a need for a chemical dispensing system having an improved chemical dispenser that allows different types of pumps to be used for different applications in an easy and cost-effective manner. There is also a need for an improved pump for the chemical dispenser that operates accurately and requires less maintenance.

SUMMARY

The present invention overcomes the foregoing and other shortcomings and drawbacks of chemical dispensing systems, chemical dispensers, and modular pumps. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, there is a chemical dispenser including a housing, a controller disposed in the housing for operating the chemical dispenser, at least one module bay in the housing, and at least one module selectively coupled to the at least one module bay and operatively coupled to the controller for operation with the chemical dispenser. The at least one module is selected from a plurality of modules each capable of being coupled to the at least one module bay and operating under the control of the controller. In one embodiment, the housing includes a plurality of module bays, each module bay is configured to receive a respective module selected from the plurality of modules.

In one embodiment, at least one of the plurality of modules is a pump. For example, more than one of the plurality of modules may be pumps and can include one or more of peristaltic pumps, diaphragm pumps, dual-piston pumps, and/or double-ended piston pumps. In one embodiment, at least one of the plurality of modules is an alarm. For example, more than one of the plurality of modules are alarms and can include visual alarms and/or audio alarms. In one embodiment, at least one of the plurality of modules is a valve. For example, more than one of the plurality of modules are valves and can include a solenoid valve.

According to another aspect, a chemical dispensing system comprises the chemical dispenser of any of the embodiments.

According to another aspect, a washing arrangement comprises a washing machine and a chemical dispensing system according to one aspect operatively coupled to the washing machine.

According to yet another aspect, a pump module for a modular chemical dispensing system comprises a module housing, a piston assembly, a drive assembly, and a valve assembly.

In one embodiment, the piston assembly comprises a piston housing defining at least two piston cylinders. At least two pistons each define a base and a piston head for positioning in respective piston cylinders. The base of the pistons is operatively coupled to the drive assembly for reciprocating the pistons relative to the piston cylinders.

In one embodiment, the piston housing includes at least one guide channel, and each piston includes at least one guide rod. The at least one guide rod is configured to be received in a respective guide channel for guiding the movement of the pistons.

In one embodiment, the drive assembly comprises a motor having a drive shaft coupled to the module housing and a gear arrangement operatively coupled to the motor and further operatively coupled to the piston assembly.

In one embodiment, the gear arrangement comprises a primary drive gear coupled to the drive shaft of the motor and a pair of secondary drive gears configured to be driven by the primary drive gear. In one embodiment, each of the secondary drive gears includes a pin eccentrically positioned relative to a rotational axis of the secondary drive gears. The pins are configured to be received within a slot in the base of the pistons for moving the pistons.

In one embodiment, the valve assembly comprises a valve housing, a pair of valves, and a product manifold. In one embodiment, the valve housing comprises a pair of valve heads. Each valve head includes a valve recess. Each valve recess includes an inlet port, an outlet port, and a valve seat. The valve seat is configured to receive one of the pair of valves. The inlet and outlet ports of each valve head are in communication with a respective one of the piston chambers. In one embodiment, the inlet port includes at least one flow aperture and a valve post. In one embodiment, the inlet port includes a pair of flow apertures with the valve post disposed therebetween.

In one embodiment, the outlet port includes an annular valve seat.

In one embodiment, the product manifold comprises an inlet channel and an outlet channel. The inlet channel is in communication with the inlet ports of each of the valve heads, and the outlet channel is in communication with the outlet ports of each of the valve heads.

In one embodiment, the piston assembly comprises a piston housing defining at least two piston cylinders, and a piston having a sliding yoke and two piston heads extending in opposing directions from the sliding yoke. Each one of the piston heads is received in a respective piston cylinder. The sliding yoke is operatively coupled to the drive assembly for reciprocating the piston relative to the two piston cylinders.

In one embodiment, one cycle of the piston in the piston assembly is configured to produce two exhaust and two intake cycles.

In one embodiment, the piston heads share a common longitudinal axis.

In one embodiment, the opposing piston heads are of different lengths.

In one embodiment, the piston heads are hollow and are open to the respective piston cylinder.

In one embodiment, the sliding yoke defines an elliptical slot and the drive assembly is movably coupled to the sliding yoke by the elliptical slot.

In one embodiment, the piston housing further defines an opening in a yoke cavity. The yoke cavity receives the sliding yoke, and the drive assembly engages the piston assembly through the opening.

In one embodiment, the piston assembly further comprises a first cylinder head secured in the piston housing and at least partially defining a portion of one piston cylinder and a second cylinder head secured in the piston housing and at least partially defining a portion of the other piston cylinder. In one embodiment, each of the first cylinder head and the second cylinder head are in fluid communication with one piston.

In one embodiment, the first cylinder head is in fluid communication with a first piston and the second cylinder head is in fluid communication with a second piston. The first piston and second piston are different pistons.

In one embodiment, the valve assembly comprises an inlet valve housing including an inlet valve in fluid communication with at least one cylinder and an outlet valve housing including an outlet valve in fluid communication with the at least one cylinder. In one embodiment, each valve is a duckbill valve.

In one embodiment, the piston housing defines two cylinders and the piston assembly further comprises a first cylinder head secured in the piston housing and at least partially defining a portion of one piston cylinder. The piston housing further comprises a second cylinder head secured in the piston housing and at least partially defining a portion of the other piston cylinder. And, the valve assembly comprises a first inlet valve housing including a first inlet valve coupled to the first cylinder head and a first outlet valve housing including a first outlet valve coupled to the first cylinder head. A second inlet valve housing includes a second inlet valve coupled to the second cylinder head, and a second outlet valve housing includes a second outlet valve coupled to the second cylinder head. Each of first inlet valve, the first outlet valve, the second inlet valve, and the second outlet valve is a duckbill valve.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
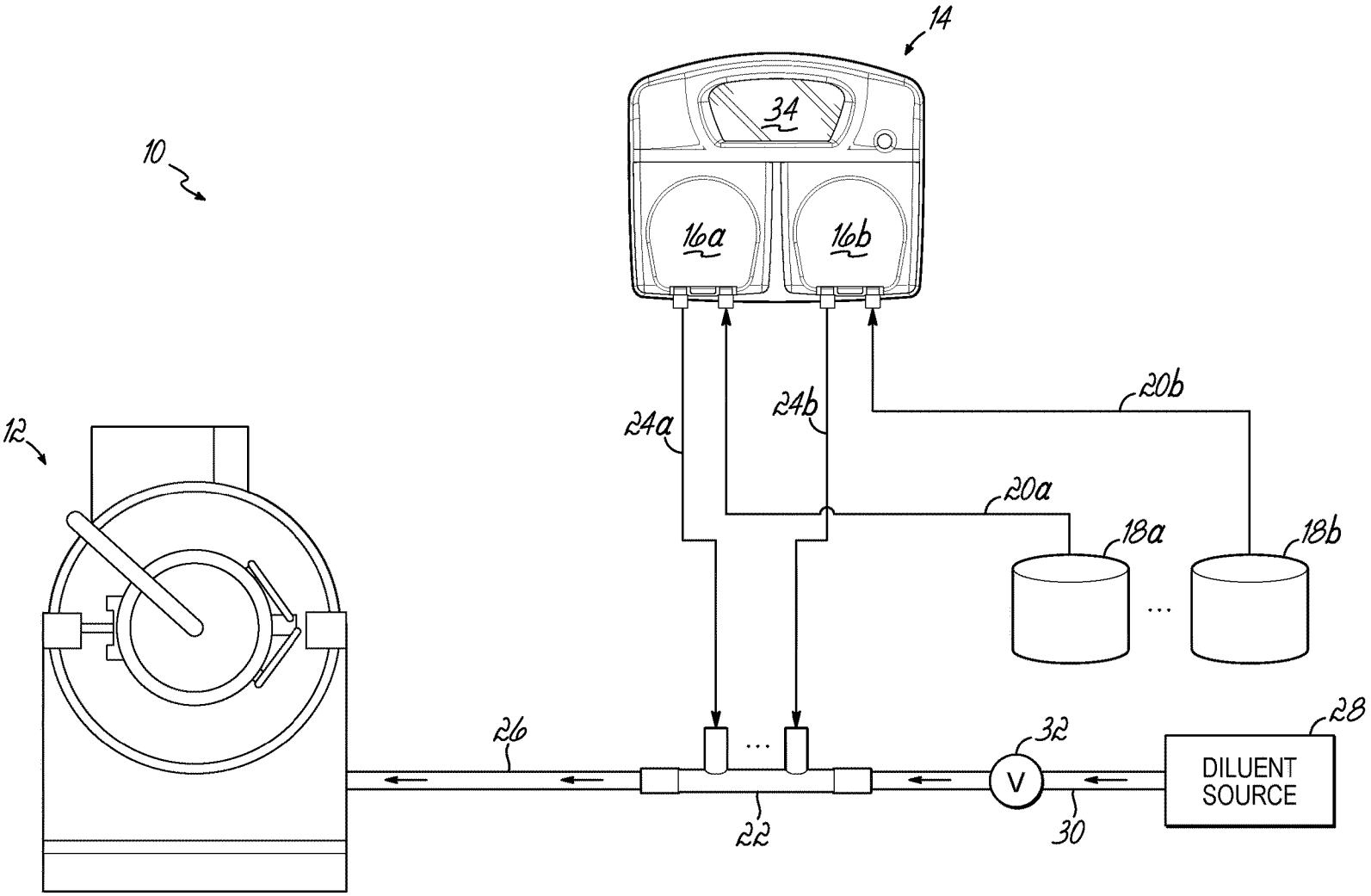
FIG. 1 is an illustration of an exemplary chemical dispensing system having a chemical dispenser in accordance with an embodiment of the present invention.

With reference to FIG. 1, an exemplary chemical dispensing system 10 for use with a washing machine 12, which may be a laundry machine is illustrated. The chemical dispensing system 10 includes a chemical dispenser 14, having at least one and preferably a plurality of pumps 16*a*, 16*b*, one or more chemical reservoirs 18*a*, 18*b* in fluid communication with respective pumps 16*a*, 16*b* via input product lines 20*a*, 20*b*, and a fluid manifold 22 in fluid communication with each of the pumps 16*a*, 16*b* via output product lines 24*a*, 24*b*. For laundry applications, there may be as many as eight pumps, reservoirs, and associated product lines. The fluid manifold 22 is in fluid communication with the washing machine 12 via a machine supply line 26 and is in further fluid communication with a diluent source 28 via a diluent supply line 30. The diluent supply line 30 may include a valve 32 operatively coupled to the chemical dispenser 14 for controlling the flow of diluent through the fluid manifold 22 and to the washing machine 12. In this regard, the chemical dispenser 14 may include a controller 34 for controlling the chemical dispenser, including, for example, the pumps 16*a*, 16*b* and the valve 32. Additional details of the controller 34 are provided in U.S. Application Ser. No. 62/843,777 ("the 777 application"), filed on May 6, 2019 and titled Dispensing System. The disclosure of the 777 application is incorporated by reference herein in its entirety.

Figure 1A:
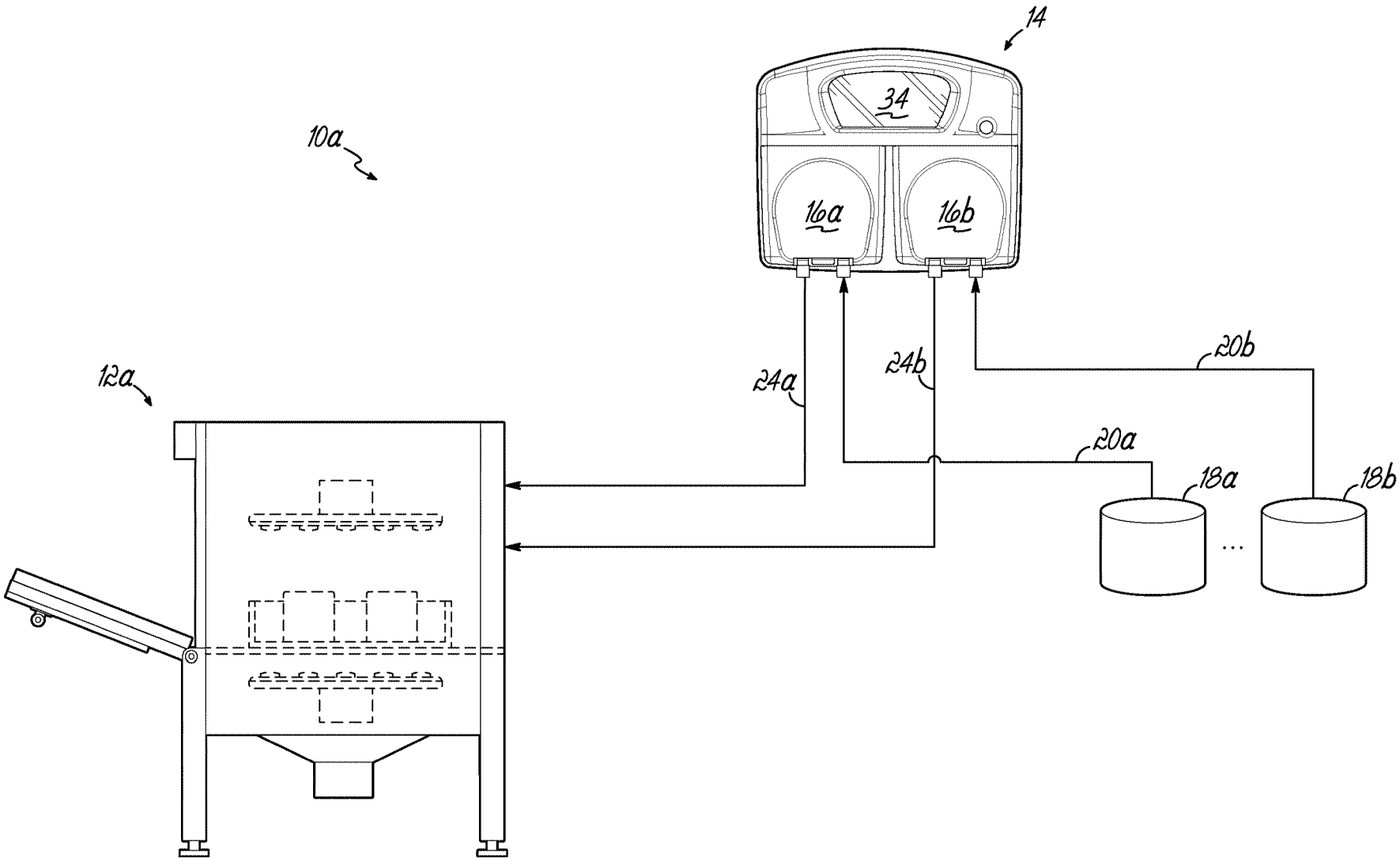
FIG. 1A is another illustration of an exemplary chemical dispensing system having a chemical dispenser in accordance with an embodiment of the present invention.

FIG. 1A illustrates another chemical dispensing system 10*a* for use with a washing machine 12*a*, which in the illustrated embodiment may be a warewash machine. The chemical dispensing system 10*a* includes a chemical dispenser 14, having at least one and preferably a plurality of pumps 16*a*, 16*b*, one or more chemical reservoirs 18*a*, 18*b* in fluid communication with respective pumps 16*a*, 16*b* via input product lines 20*a*, 20*b*, and output product lines 24*a*, 24*b* in communication with the washing machine 12*a*. In this application, for example, the fluid manifold 22 may be omitted and the pumps 16*a*, 16*b* may be directly coupled to the washing machine 12*a*. For warewash applications, there may be as many as three pumps, reservoirs, and associated product lines. It should be recognized that aspects of the present invention are not limited to laundry and warewash applications but may apply to a host of other industries including the textile, healthcare, and food processing industries. Additionally, aspects of the invention are not limited to any particular number of pumps, reservoirs, product lines, etc., which may be based on the particular application.

Figure 2:
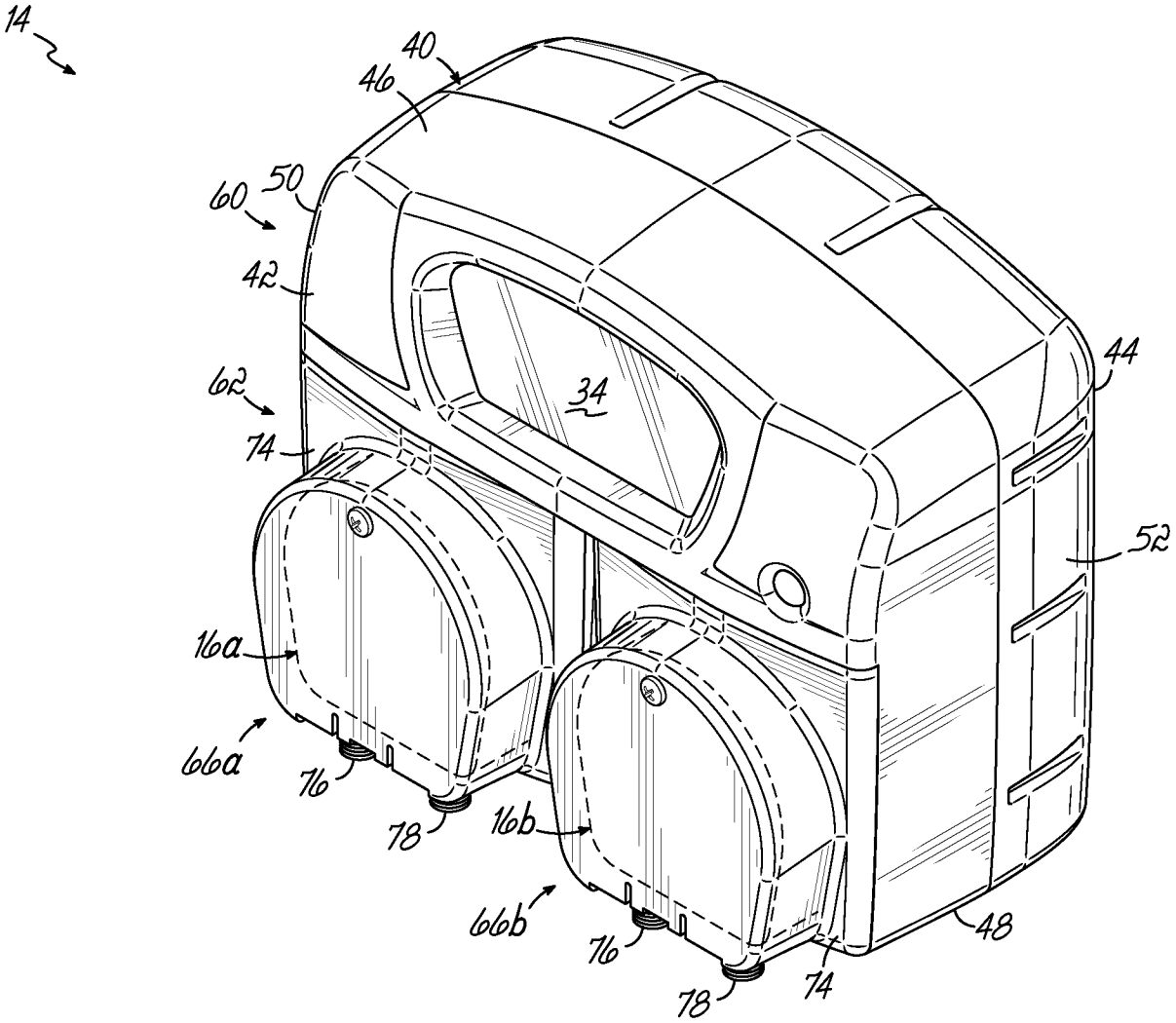
FIG. 2 is a perspective view of a chemical dispenser in accordance with an embodiment of the present invention.

FIG. 2 illustrates a chemical dispenser 14 in accordance with an exemplary embodiment of the invention. The chemical dispenser 14 includes an outer housing 40 for holding the one or more pumps 16*a*, 16*b* and a controller 34. In one embodiment, the housing 40 may be generally rectangular in shape and include a front panel 42, rear panel 44, top panel 46, bottom panel 48, and side panels 50, 52 that collectively define a housing interior 54. It should be recognized, however, that the housing 40 is not limited to this shape as other housing shapes and configurations are possible within the scope of the invention. The housing 40 may be formed from a suitable material, such as a strong engineering plastic, through an injection molding process, for example. Other materials and forming processes are also possible.

The chemical dispenser 14 may be configured to be mounted to a wall or stand at an industrial facility or the like in relatively close proximity to the washing machine 12. In this regard, the rear panel 44 may include various fasteners or features that facilitate the mounting of the chemical dispenser within the facility. The front panel 42 of the chemical dispenser 14 generally includes a controller section 60 and a module section 62. In one embodiment, the controller section 60 occupies an upper portion of the front panel 42 of the chemical dispenser 14 and the module section 62 occupies a lower portion of the front panel 42 of the chemical dispenser 14. The invention, however, is not limited to such an arrangement as the controller section 60 and the module section 62 may be reversed or alternatively placed side-by-side.

The controller section 60 includes various features for a user to interact with the controller 34 and/or observe performance features of the chemical dispenser 14. By way of example, the controller section 60 may include various buttons, such as standby buttons, prime buttons, etc., and/or various indicators, such as dispenser status indicators (e.g., light-emitting diodes), pump status indicators, etc. The controller section 60 may further include a user input interface (e.g., touchscreen) and/or user output interface. Additional details of the controller section 60 may be found in the 777 application.

Figure 3:
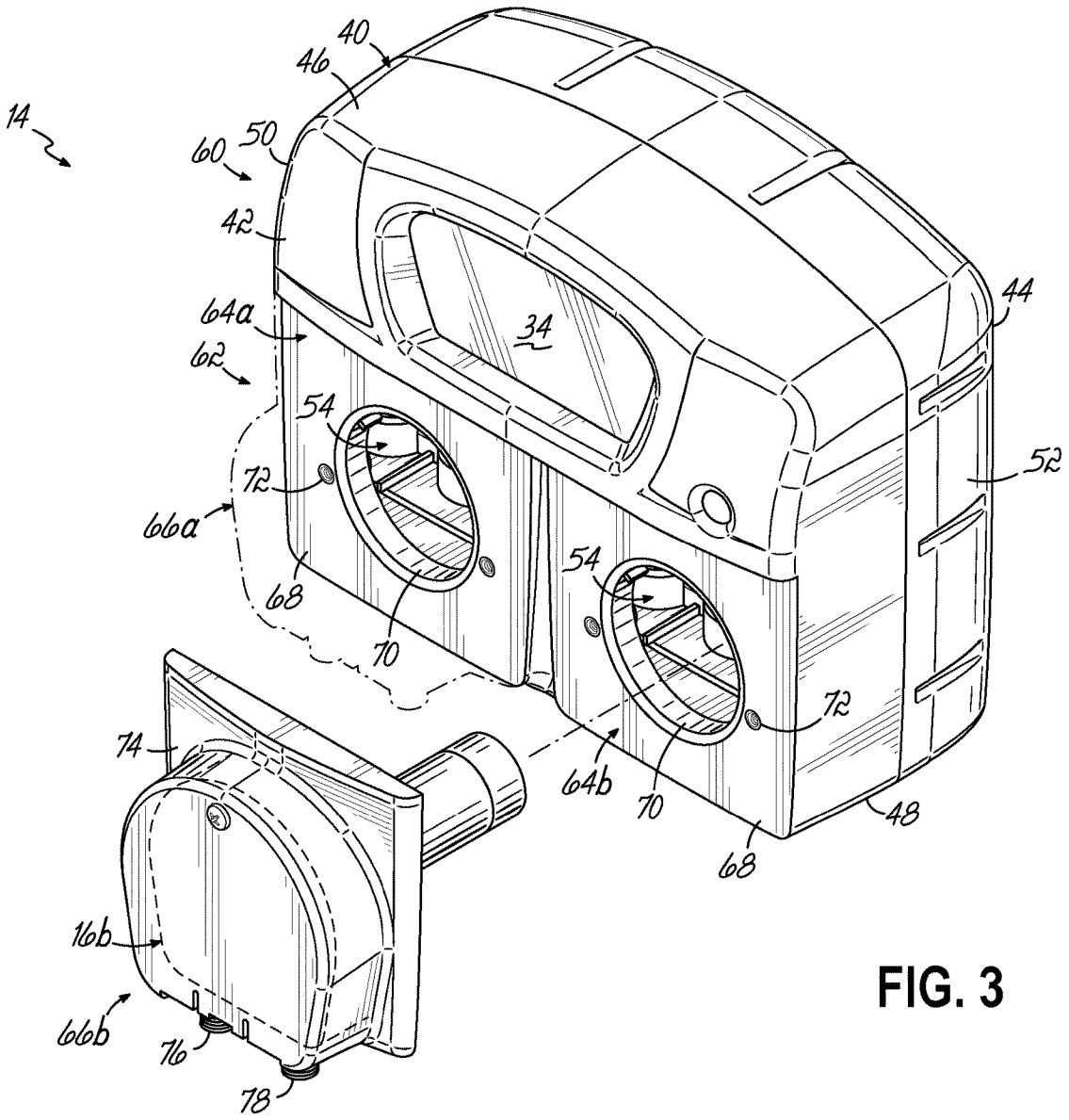
FIG. 3 is a partially disassembled perspective view of the chemical dispenser shown in FIG. 2.
Figure 4:
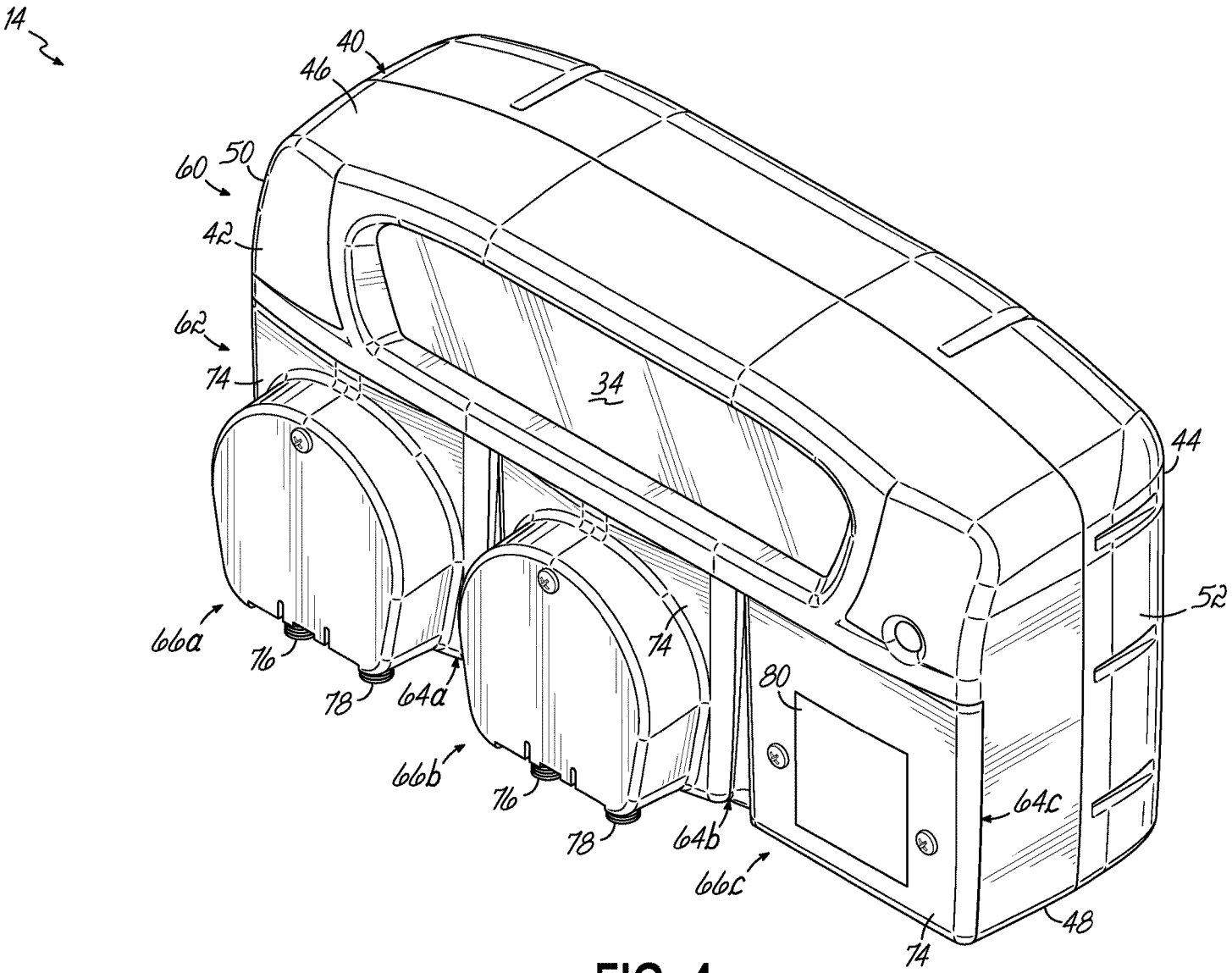
FIG. 4 is a perspective view of a chemical dispenser in accordance with another embodiment of the present invention.

In accordance with an aspect of the invention, the chemical dispenser 14 is configured to be modular and capable of receiving a variety of different types of modules in the housing 40 in a plug-and-play manner. In this regard and as illustrated in FIGS. 2 and 3, the module section 62 is configured to include a plurality of module bays 64*a*, 64*b* each configured to receive a module 66*a*, 66*b* for use with the chemical dispenser 14. While two module bays 64*a*, 64*b* and corresponding modules 66*a*, 66*b* are shown with chemical dispenser 14, it should be recognized that the module section 62 of the chemical dispenser 14 may include more or fewer bays and modules. FIG. 4, for example, illustrates three module bays 64*a*, 64*b*, 64*c* and corresponding modules 66*a*, 66*b*, 66*c*. Thus, the chemical dispenser 14 may include most any desired number of module bays 64 and modules 66 to meet the needs of a particular application.

As illustrated in FIG. 3, each module bay 64*a*, 64*b* includes a generally rectangular support surface 68 having an aperture 70 open to the interior 54 of the housing 40. The support surface 68 may also include one or more fastening elements for securing a module 66 to a respective module bay 64. For example, in an exemplary embodiment, the support surface 68 may include one or more threaded bores 72 configured to receive a screw (not shown) for securing a module 66 to a module bay 64. The invention is not limited to such fastening elements. For example, other types of fasteners may be used to secure a module 66 to a module bay 64, including various clamps, clips, latches, magnets, etc. In any event, the module 66 may be easily and selectively coupled and decoupled from the modular bays 64.

As further illustrated in FIGS. 2 and 3, each module 66 includes a generally rectangular face plate 74 configured to engage with the support surface 68 of the module bays 64 when the modules 66 are coupled to the chemical dispenser 14. In this regard, the modules 66 may include one or more fastening elements (not shown) for securing the modules 66 to a respective module bay 64. The modules 66 may each have a substantially similar size and be configured to mount to any of the module bays 64 on the chemical dispenser 14. Moreover, the modules 66 may provide a variety of functions to the chemical dispenser 14. For example, in one embodiment a module 66 may be configured as a pump for the chemical dispenser 14. In another embodiment, the module 66 may be configured as an alarm for the chemical dispenser 14. In yet another embodiment, the module 66 may be configured as a valve for the chemical dispenser 14. Thus, the modules 66 may be different from each other but yet be configured to be mounted to any of the module bays 64 in the dispenser housing 40. Furthermore, each of the module bays 64 may include an interface, such as a wire harness (not shown), for operatively coupling the modules 66 to the controller 34, thereby allowing the controller 34 to control operation of the modules 66 coupled to the module bays 64. This type of modularity and plug-and-play capability provides designers, manufacturers, and consumers of chemical dispensing systems a wider range of options when designing a laundry or wash-ware application, for example.

As noted above, the module 66 may take the form of a pump 16. In accordance with an aspect of the invention, the pump 16 may be one of several designs each configured to be mounted to a module bay 64 of the chemical dispenser 14. By way of example and without limitation, the module 66 may be configured as a peristaltic pump. Alternatively, the module 66 may be configured as a diaphragm pump. Still further, and as discussed in more detail below, the module 66 may be configured as a dual-piston pump or double-ended piston pump. Thus, depending on the particular application and the desire of the consumer, different types of pumps 16 may be coupled to the chemical dispenser 14 in an interchangeable manner and without any difficulty. As illustrated in FIGS. 2 and 3, each of the pumps 16 includes an inlet 76 configured to be coupled to an input product line 20 from a chemical reservoir 18, and an outlet 78 configured to be coupled to an output product line 24 connected to the fluid manifold 22. The pumps 16 associated with the chemical dispenser 14 may all be the same type of pump 16 or may be different from each other. For example, a peristaltic pump may be positioned in one of the module bays 64 while a dual-piston pump or double-ended piston pump may be positioned in another module bay 64. Thus, a great variety of pumps and arrangements in the chemical dispenser 14 are possible in embodiments of the present invention.

As illustrated in FIG. 4, a module 66*c* may take the form of an alarm 80 configured to notify a user when an error condition of the chemical dispenser 14 is detected by the controller 34. In one embodiment, the alarm 80 may be a visual alarm having, for example, different colored lights that indicate the operation of the chemical dispenser 14. By way of example, when the chemical dispenser 14 is operating normally, the alarm 80 may illuminate as a green light. When a non-emergency error condition exists in the chemical dispenser 14, the alarm 80 may illuminate as a yellow light indicating that action should be taken in the near future. Furthermore, when an error condition is detected that requires immediate attention, the alarm 80 may illuminate as a red light. The invention is not limited to this arrangement of lights and it should be recognized that a module 66 may include a different type of visual alarm.

In an alternative embodiment, the alarm 80 may be configured as an audio alarm having, for example, different sounds or frequency of sounds that indicate the operation of the chemical dispenser. Thus, by way of example, when the chemical dispenser 14 is operating normally, the alarm 80 may project a first sound at a first frequency (e.g., low frequency). When a non-emergency error condition exists in the chemical dispenser 14, the alarm 80 may project a second sound at a second frequency (slightly higher frequency) indicating that action should be taken in the near future. Furthermore, when an error condition is detected that requires immediate attention, the alarm 80 may project a third sound at a third frequency (e.g., high frequency). The invention is not limited to this arrangement of sounds/frequency and it should be recognized that a module 66 may include a different type of audio alarm.

In yet a further embodiment, a module 66 may be configured as a valve (not shown), such as, for example, a solenoid valve. By way of example, the valve module 66 of this embodiment may take the place of valve 32 (FIG. 1) such that the diluent source 28 is now in fluid communication with an inlet of a module 66 of the chemical dispenser 14 and the fluid manifold 22 is in fluid communication with an outlet of the module. Thus, a module 66 of the chemical dispenser 14 controls the flow of diluent through the chemical dispensing system 10.

While the modules 66 of the chemical dispenser 14 have been described herein as pumps, alarms, and valves, it should be recognized that modules providing other functions may be possible and within the scope of the present invention. By way of example, other functionalities that may be performed by one or more modules 66 include various types of out-of-product indicators, such as optical or other types of indicators, and/or proof of delivery indicators that confirm the delivery and/or amount of chemical product dispensed to the washing machine.

The modular design of the chemical dispenser 14 provides a number of advantages. As an initial matter, the chemical dispenser 14 provides a versatile design that allows designers, manufacturers and customers to configure a dispenser that meets their specific needs. The plug-and-play feature of the modules 66 allows the chemical dispenser 14 to be easily configured or reconfigured for a particular application. Additionally, performing maintenance on the chemical dispenser 14 has been greatly enhanced. For example, should a pump 16 of the chemical dispenser 14 stop working properly, the malfunctioning pump may be removed from the housing 40 and replaced with a new or refurbished pump in a quick and relatively easy repair procedure. In short, the chemical dispenser 14 is versatile and may be configured to meet the needs in a wide range of applications and configurations. Moreover, the interchangeability of the modules improves maintenance/repairs and reduces outages of the chemical dispensing system 10.

FIGS. 5-7D illustrate an improved pump module 90 in accordance with an embodiment of the invention. The pump module 90 may be just one of the types of modules 66 used in chemical dispenser 14 described above. In accordance with an aspect of the invention, the pump module 90 may be configured as a dual-piston pump capable of relatively constant fluid flow over fairly short cycle times. The dual-piston pump module 90 is also configured to be low maintenance and capable of very long run times before any maintenance operations are necessary to ensure the accurate dispensing of chemical product from the chemical dispenser 14. This further reduces the maintenance costs and down time for the chemical dispensing system 10.

Figure 5:
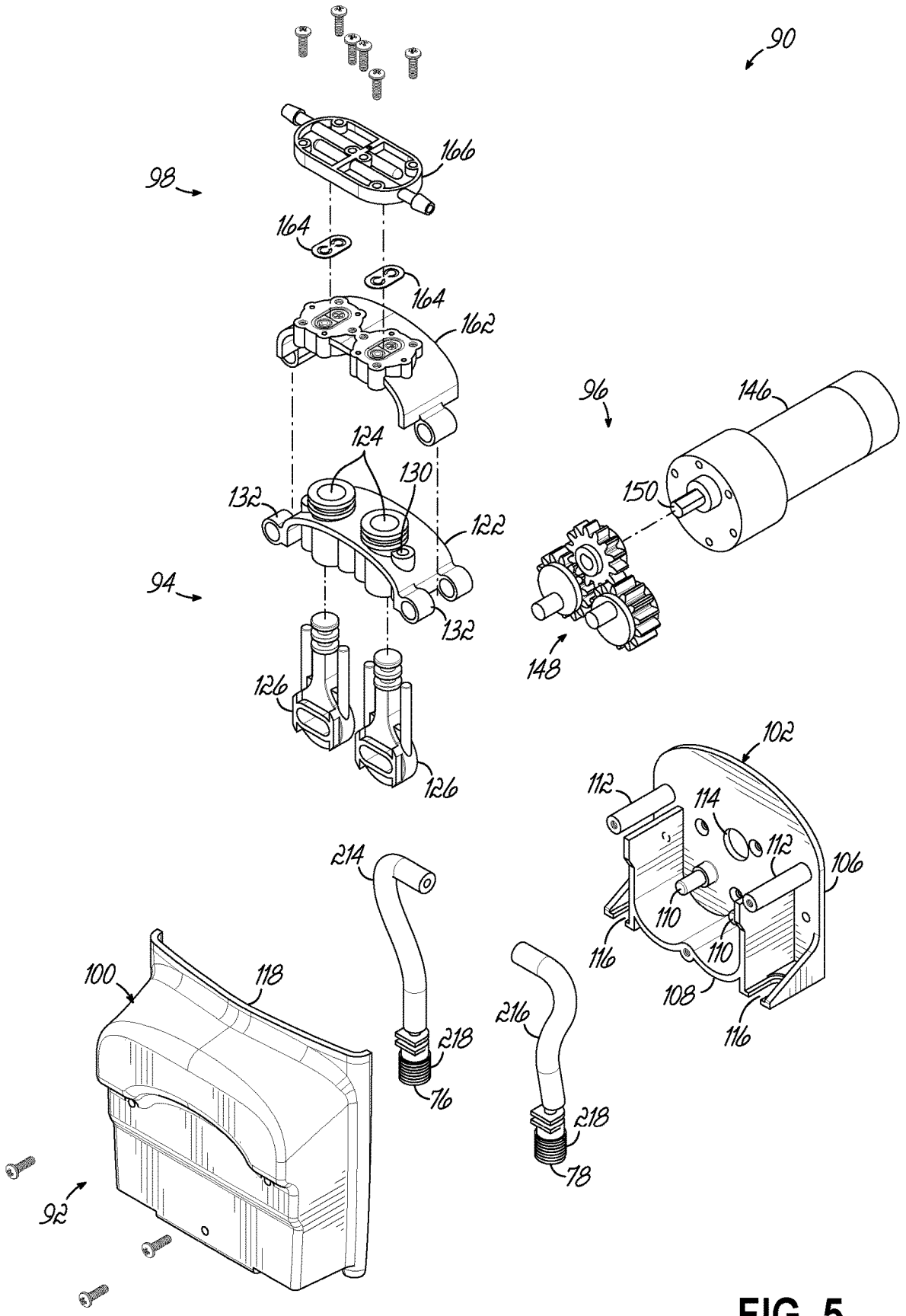
FIG. 5 is a disassembled perspective view of a dual-piston pump module in accordance with an embodiment of the present invention.

A disassembled dual-piston pump module 90 in accordance with an embodiment of the invention is illustrated in FIG. 5 and broadly includes a module housing 92, a piston assembly 94, a drive assembly 96, and a valve assembly 98. The module housing 92 includes a front housing portion 100 and a rear housing portion 102 which fit together to form the module housing 92 with an interior 104 for housing the components of the pump. The rear housing portion 102 includes a generally planar wall 106, a U-shaped support or frame 108 extending from an inner surface of the wall 106, a pair of spindles 110 extending from the wall 106 within the U-shaped frame 108, and a pair of support posts 112 extending from the wall 106 above and outboard of the U-shaped frame 108. The rear housing portion 102 further includes a drive aperture 114 in the wall 106 centrally located above and between the spindles 110 and a pair of slots 116, the purpose of which will be described below, at a lower end of the rear housing portion 102. The front housing portion 100 generally defines a cavity 118 and effectively operates as a cover for the internal components of the pump module 90. The front and rear housing portions 100, 102 may be coupled together by fasteners, such as screws, which are received in threaded bores in the rear housing portion 102. For example, the ends of the posts 112 may include threaded bores and the U-shaped frame 108 may include a threaded bore. Other fastening arrangements are possible, however. Additionally, the front and rear housing portions 100, 102 may be made (e.g., molded) from suitable engineering plastics.

Figure 5A:
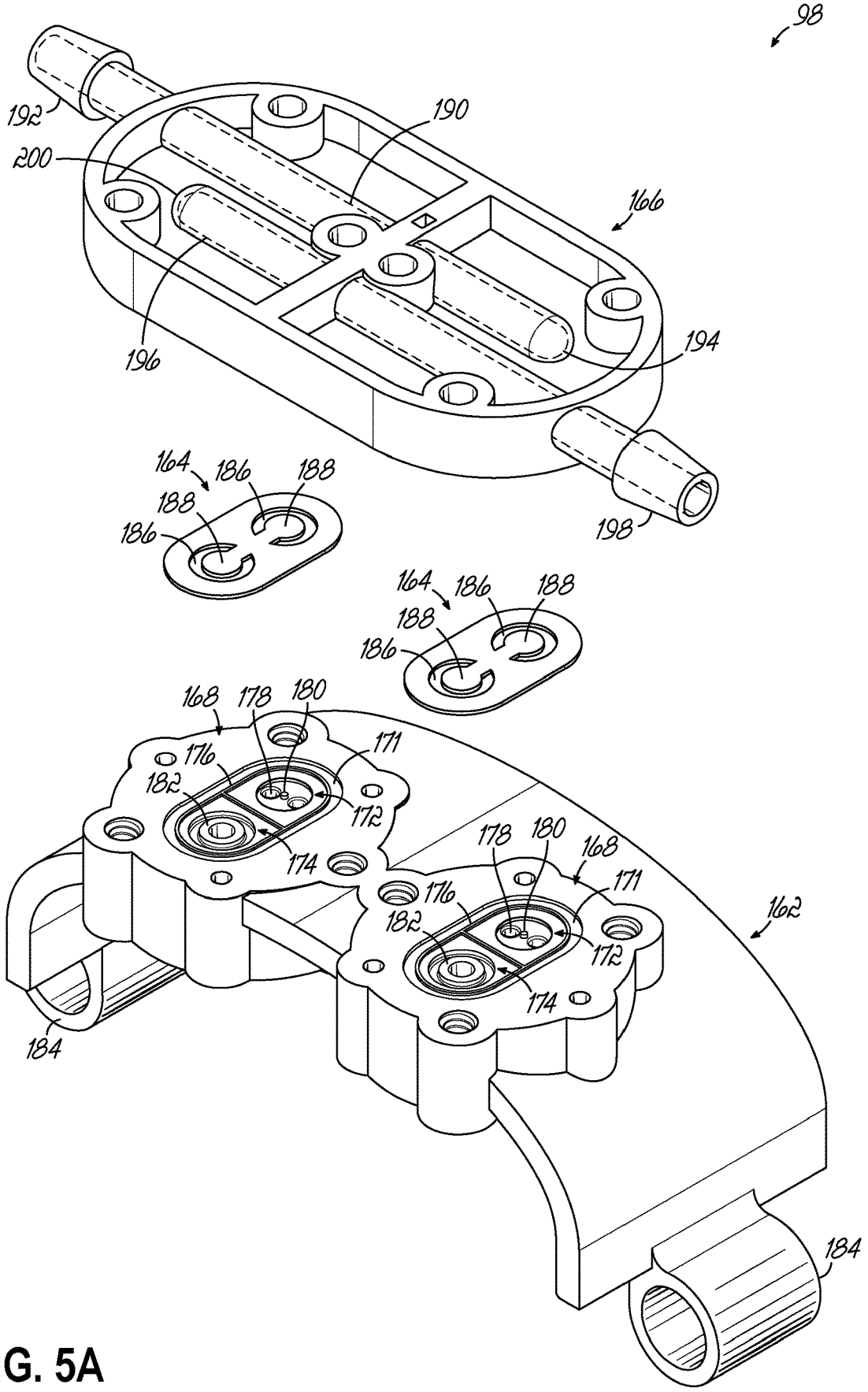
FIG. 5A is a partially disassembled perspective view of a valve arrangement for the dual-piston pump module shown in FIG. 5.
Figure 5B:
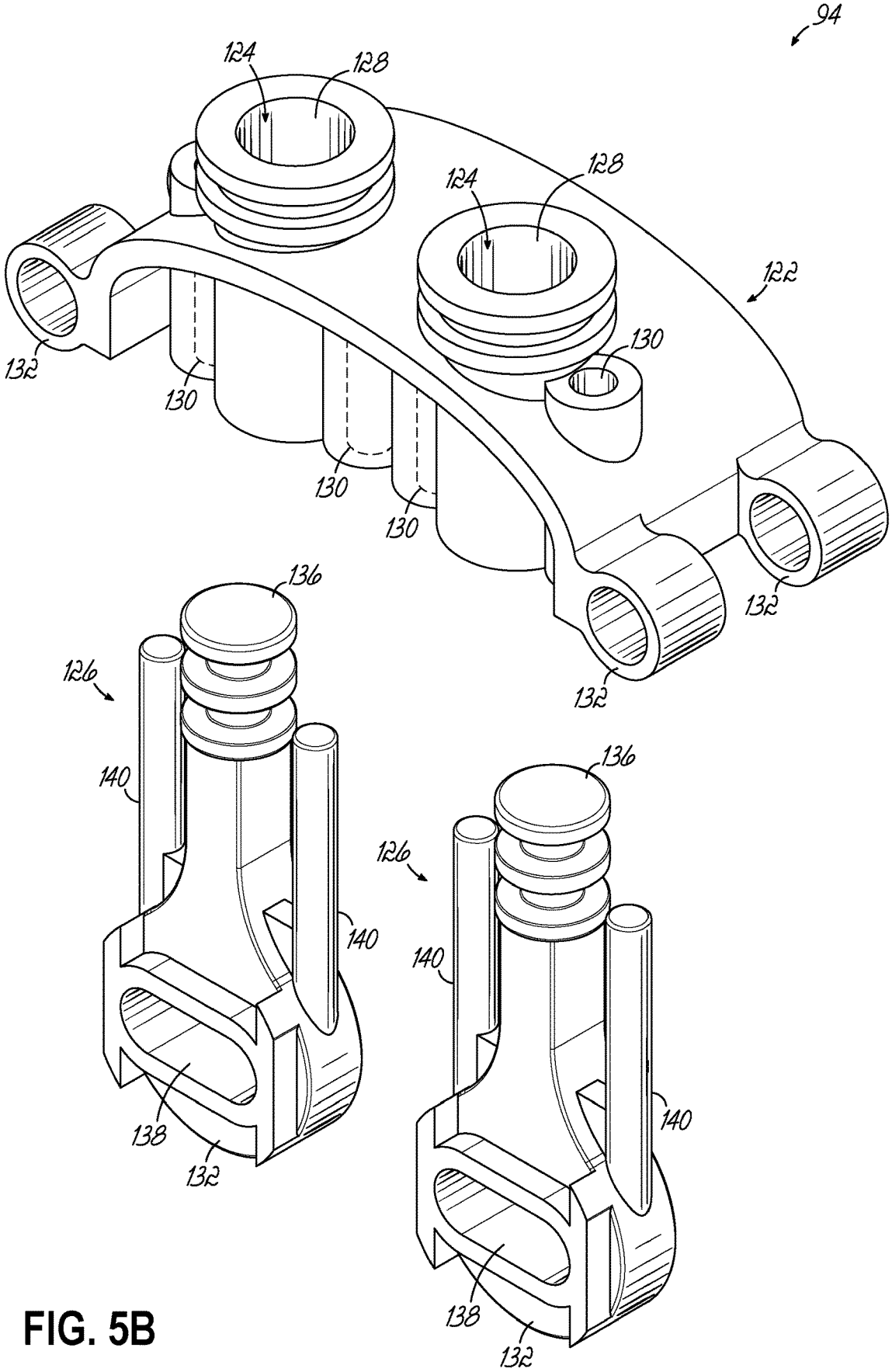
FIG. 5B is a partially disassembled perspective view of a piston assembly for the dual-piston pump module shown in FIG. 5.

As illustrated in FIGS. 5 and 5B, the piston assembly 94 includes a piston chamber housing 122 defining a pair of piston chambers 124 and a pair of pistons 126 each configured to be received within a respective piston chamber 124 of the piston chamber housing 122. The piston chambers 124 are defined by respective generally cylindrical walls or piston cylinders 128 that are open at both an upper end and lower end thereof. The piston chamber housing 122 further includes a pair of guide channels 130 on opposing sides of each of the cylindrical walls 128 that define the piston chambers 124. The purpose of the guide channels 130 is explained in more detail below. The lateral ends of the piston chamber housing 122 further include a pair of support tubes 131 for securing the piston chamber housing 122 to the pump module 90, and more particularly to the rear housing portion 102 of the module housing 92. In this regard, the piston chamber housing 122 is sized to fit generally between the posts 112 such that the support tubes 131 are configured to be slidably received over the posts 112.

With reference to FIG. 5B, each of the pistons 126 include a generally circular base 132 and an elongate stem 134 extending from the base 132 and terminating in a piston head 136. The base 132 includes a generally oval or elliptical slot 138 configured to receive a portion of the drive assembly 96 for moving the pistons 126 relative to the piston chambers 124, as will be discussed in more detail below. The piston heads 136 are sized to be slidably received within the piston chambers 124 of the piston chamber housing 122. In this regard, the piston heads 136 may include one or more seals (e.g., O-rings) that form a substantially fluid tight interface between the piston heads 136 and the cylindrical walls 128 during operation of the pump module 90. In addition, the pistons 126 may include a pair of guide rods 140 extending from the base 132 on opposed sides of the stem 134 and configured to be received within the guide channels 130 in the piston chamber housing 122 during operation. The interaction between the guide rods 140 on the pistons 126 and the guide channels 130 in the piston chamber housing 122 maintains the movement of the pistons 126 in a single direction, e.g., in a substantially vertical direction.

Figure 5C:
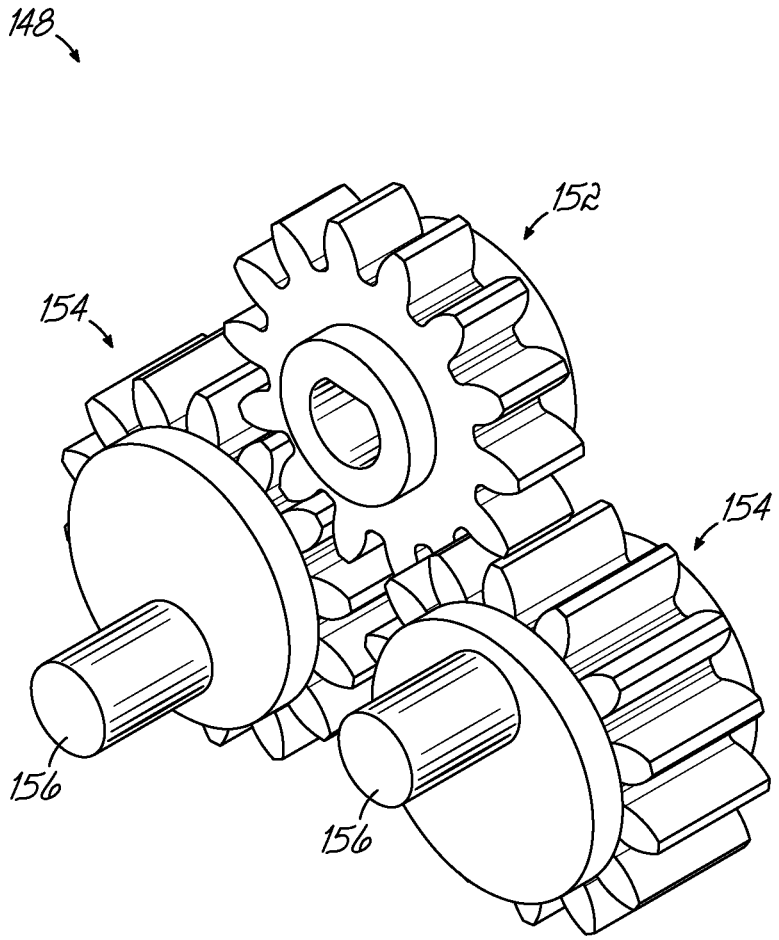
FIG. 5C is a partial perspective view of a drive assembly for the dual-piston pump module shown in FIG. 5.

As illustrated in FIGS. 5 and 5C, the drive assembly 96 includes a motor 146 and a gear arrangement 148 operatively coupled to the motor 146 and to the piston assembly 94 for reciprocating the pistons 126 within the piston chambers 124. As illustrated in FIG. 5, the motor 146 is configured to be coupled to the module housing 92 and includes a rotatable drive shaft 150 extending from the motor 146 and into the interior 104 of the module housing 92. In this regard, the wall 106 of the rear housing portion 102 includes one or more bores configured to receive fasteners (e.g., screws) that secure the motor 146 to the wall 106 of the rear housing portion 102. When so secured, the drive shaft 150 extends through the drive aperture 114 in the wall 106 of the rear housing portion 102. As is shown in FIG. 5C, the gear arrangement 148 includes a primary drive gear 152 and a pair of secondary drive gears 154. The primary drive gear 152 is received on the drive shaft 150 of the motor 146 and is rotatably driven by the motor 146. The secondary drive gears 154 are each received on a respective spindle 110 and are configured to mesh with the primary drive gear 152 such that the secondary drive gears 154 are rotatably driven by the primary drive gear 152 with activation of the motor 146. In one embodiment, the ratio between the primary and second gears may be 1:1 such that a single rotation of the primary gear results in a single rotation of the secondary gears 154. The invention is not limited to this ratio, however, as other gear ratios are possible depending on the particular application, for example.

The secondary drive gears 154 each include an eccentrically located pin 156 extending from a face of the secondary drive gears 154. For example, the pins 156 may be located adjacent an outer portion of the drive gears 154 such that the pins 156 rotate about the central axis of the secondary drive gears 154. As illustrated in FIGS. 6A, 6B, 7A and 7B, each pin 156 is configured to be received within a respective elliptical slot 138 in the base 132 of respective pistons 126. As the secondary drive gears 154 rotate, the eccentrically located pins 156 slide within the slots 138 in the pistons 126 (e.g., side-to-side) and also move the pistons 126 vertically within and relative to the piston chambers 124 of the piston-chamber housing 122. The secondary drive gears 154 and associated pins 156 may be arranged such that when one of the pistons 126 is positioned at top dead center relative to its piston chamber 124, the other piston 126 is positioned at bottom dead center relative to its piston chamber 124 (i.e., the pistons 126 are at opposite ends of their respective strokes). Thus, when the motor 146 is energized, the primary drive gear 152 drives the secondary drive gears 154, which in turn cause reciprocating movement of the pistons 126 within their respective piston chambers 124. The use of a dual-piston arrangement as a pump, however, involves the coordinated use of a valve arrangement, to which we now turn.

As illustrated in FIGS. 5 and 5A, the valve assembly 98 includes a valve housing 162, a pair of valves 164, and a product manifold 166. As illustrated in more detail in FIG. 5A, the valve housing 162 includes a pair of valve heads 168 configured to be positioned above the piston chambers 124 of the piston chamber housing 122. As illustrated in FIGS. 6A, 6B, 7A, 7B, each of the valve heads 168 include a bore 170 configured to receive a portion of the piston chamber housing 122 therein. Moreover, each of the valve heads 168 include a generally elliptical valve recess manifold 171 that defines an inlet port 172, and outlet port 174 and an outer valve seat 176 positioned about the inlet and outlet ports 172, 174 for receiving a valve 164. The inlet and outlet ports 172, 174 of each valve head 168 are in communication with a respective bore 170. The inlet port 172 includes at least one and preferably two flow apertures 178 therein and a valve stem or post 180 positioned between the two flow apertures 178. The outlet port 174 includes an annular valve seat 182 positioned therein and defining an aperture in communication with a respective bore 170.

The lateral ends of the valve housing 162 further include a support tube 184 for securing the valve housing 162 to the pump module 90, and more particularly to the rear housing portion 102 of the module housing 92. In this regard, the valve housing 162 is sized such that support tubes 184 are configured to be slidably received over the posts 112. More particularly, as illustrated in FIGS. 6A, 6B, 7A, 7B when the valve housing 162 and the piston chamber housing 122 are coupled together, the upper ends of the cylindrical walls 128 that define the piston chambers 124 are received in the bores 170 of the valve heads 168 and the support tube 184 of the valve housing 162 fits between and aligns with the support tubes 131 of the piston chamber housing 122 such that the combined assembly may be slidably received over the posts 112 of the module housing 92. When assembled, the inlet and outlet ports 172, 174 of each valve head 168 are in communication with a respective piston chamber 124 of the piston assembly 94. Thus, each piston chamber 124 has associated therewith an inlet port 172 for allowing chemical product into the piston chamber 124 and an outlet port 174 for allowing chemical product to be expelled from the piston chamber 124.

As illustrated in FIGS. 5 and 5A, each of the valves 164 is generally elliptical in shape to correspond to the elliptical shape of the valve seat 176 in the valve recess 171 in the valve heads 168. Each valve 164 includes a pair of confronting C-shaped cutouts 186 that generally define a pair of generally circular valve flaps 188, the purpose of which will be described below. When the valves 164 are positioned in the valve seats 176 of the valve housing 162, one of the valve flaps 188 engages against the annular valve seat 182 in the outlet ports 174, and the other valve flap 188 engages against the top of the valve post 180 in the inlet ports 172. This may be envisioned, for example, by moving the valves 164 illustrated in FIG. 5A down into their respective valve seats 176 in the valve housing 162. The valves 164 may be made from a suitable elastomeric material that provides some flexing of the material under fluid pressure. For example, the valves 164 may be made from various elastomeric materials, such as fluroelastomers (e.g., Viton®).

The product manifold 166 provides for chemical product input to the pump module 90 and chemical product output from the pump module 90 and is configured to be coupled to the valve housing 162, such as by suitable fasteners. The product manifold 166 includes an inlet channel 190 having a connector 192 at one end and is closed off at the other end 194, and an outlet channel 196 having a connector 198 at one end and is closed off at the other end 200. The inlet ports 172 are configured to be in selective communication with the inlet channel 190, and the outlet ports 174 are configured to be in fluid communication with the outlet channel 196 (e.g., via the valves 164). The product manifold 166 includes a plurality of ports 202 (see FIGS. 6C, 6D, 7C, and 7D) that generally overlie and align with the valve recess 171 in the valve heads 168 when the product manifold 166 and valve housing 162 are coupled together. Similar to the above, the product manifold 166 defines a pair of inlet ports 204 and a pair of outlet port 206 corresponding to the inlet and outlet ports 172, 174 in the valve housing 162. The configuration of the inlet and outlet ports 204, 206 in the product manifold 166 are generally opposite to that in the valve housing 162. Thus, the inlet ports 204 include an annular valve seat 208 and the outlet ports 206 include at least one and preferably two flow apertures 210 with a valve stem or post 212 positioned between the two flow apertures 210. As further demonstrated in FIGS. 6A, 6B, 7A, 7B the valve assembly 98 further includes inlet and outlet tubing 214, 216 extending from their respective connectors 192, 198 to the inlet and outlet 76, 78 of the pump module 90, which may be defined by connectors 218 that slidably engage with the slots 116 in the module housing 92.

To assemble the pump module 90, the motor 146 may be coupled to the rear housing portion 102 using, for example, suitable fasteners. When so fastened, the drive shaft 150 extends through the drive aperture 114 so as to extend within the interior 104 of the module housing 92. Next, the gear arrangement 148 may be positioned in the module housing 92. In this regard, the primary drive gear 152 may be positioned on the drive shaft 150 and the secondary drive gears 154 may be positioned on the spindles 110 so that the teeth of the gears 152, 154 mesh together. Either prior to the above or subsequent to the above (and separate from the above), the valves 164 may be positioned in their respective valve seats 176 of the valve housing 162 and the product manifold 166 coupled to the valve housing 162 using suitable fasteners. Next, the valve housing/product manifold assembly may be positioned relative to and optionally coupled to the piston chamber housing 122 such that the support tubes 131, 184 are generally aligned. Next, the pistons 126 may be inserted into their respective piston chambers 124 in the piston chamber housing 122 so that the guide rods 140 engage with their respective guide channels 130. The pistons 126 may be frictionally held to the piston chamber housing 122. Next, that entire subassembly may be inserted into the module housing 92 by sliding the aligned support tubes 131, 184 over the posts 112 and positioning the pistons 126 so that the pins 156 from the secondary drive gears 154 extend into a slot 138 in a respective piston 126. The inlet and outlet tubing 214, 216 may then be coupled to connectors 192, 76 and 198, 78, respectively. Lastly, the front housing portion 100 may be coupled to the rear housing portion 102 using suitable fasteners. The pump module 90 is then assembled and ready to be inserted into one of the module bays 64 of the chemical dispenser 14.

Figure 6A:
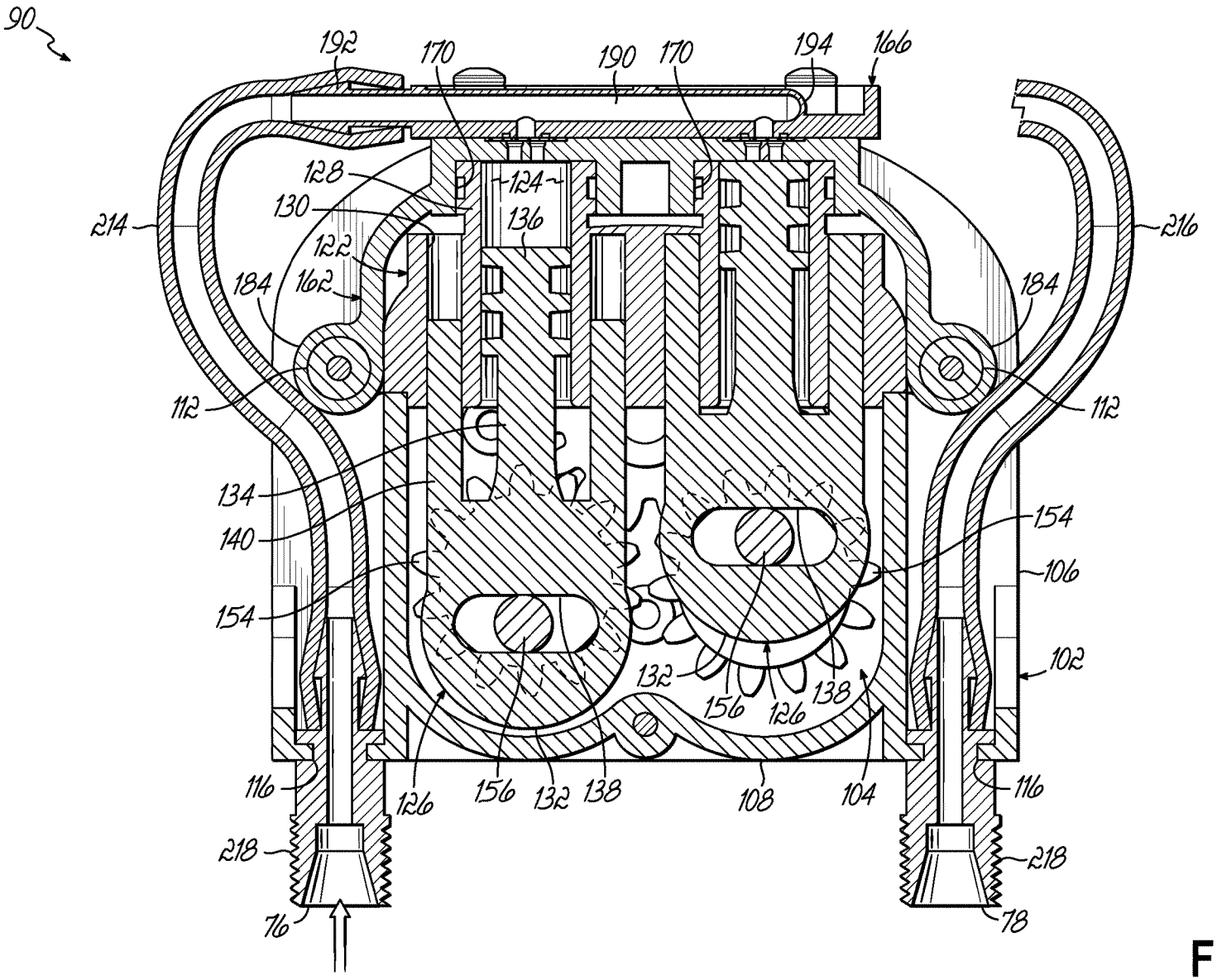
FIG. 6A is a cross-sectional view of the dual-piston pump module illustrating the inflow of chemical product to the pump.
Figure 6B:
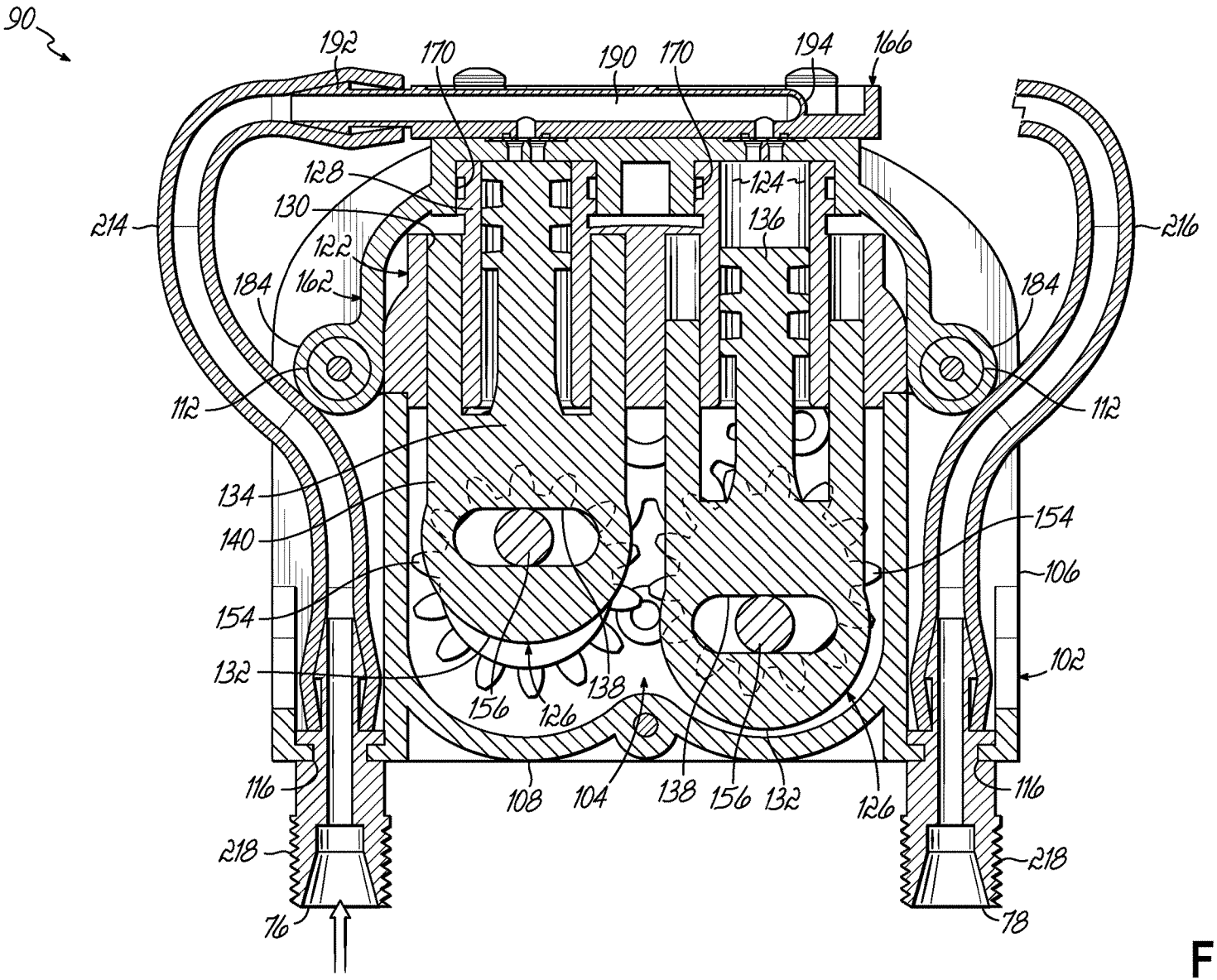
FIG. 6B is another cross-sectional view of the dual-piston pump module illustrating the inflow of chemical product to the pump.
Figure 6C:
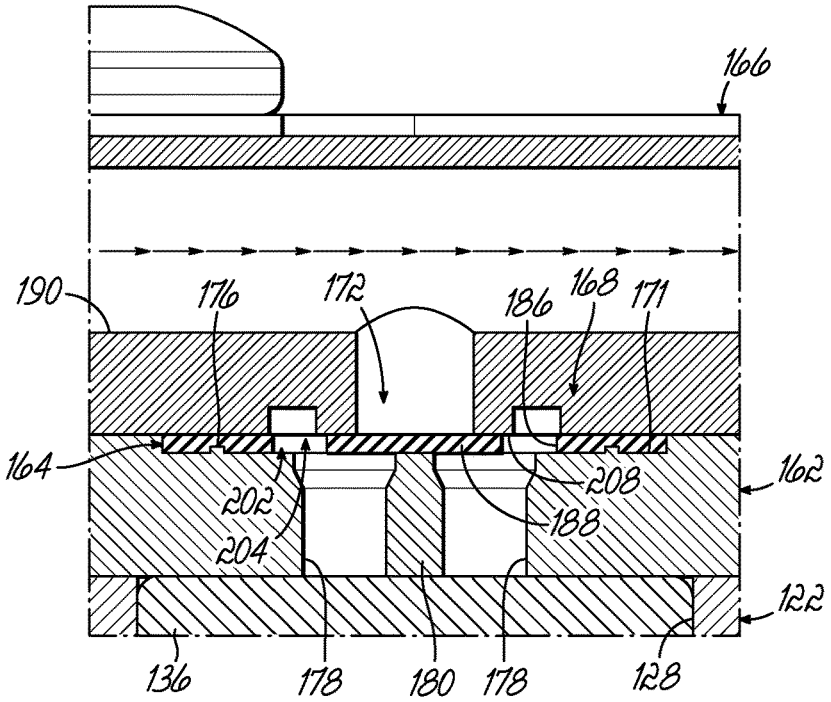
FIG. 6C is an enlarged partial view of the valve arrangement during the inflow of chemical product to the pump.
Figure 6D:
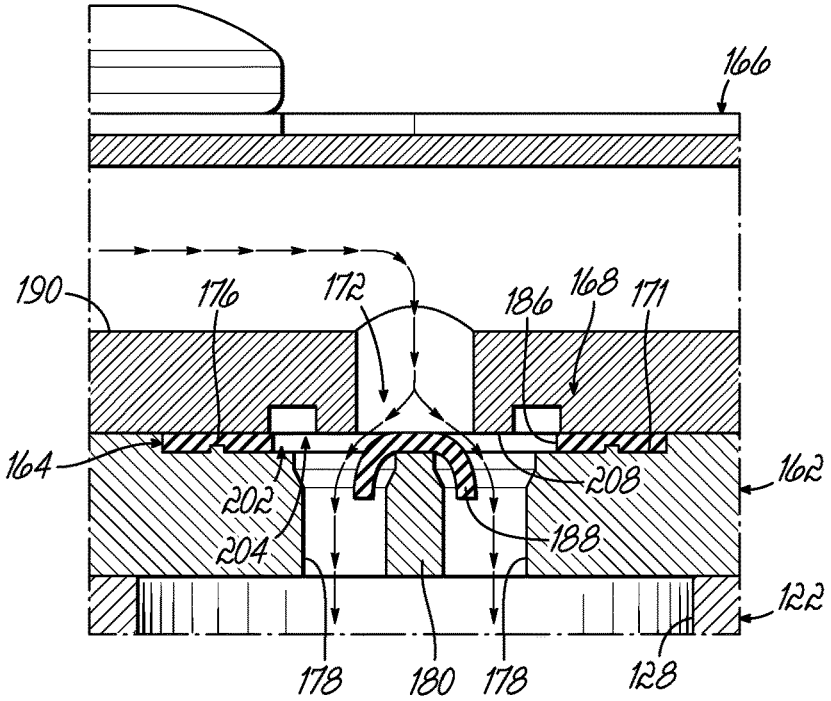
FIG. 6D is another enlarged partial view of the valve arrangement during the inflow of chemical product to the pump.
Figure 7A:
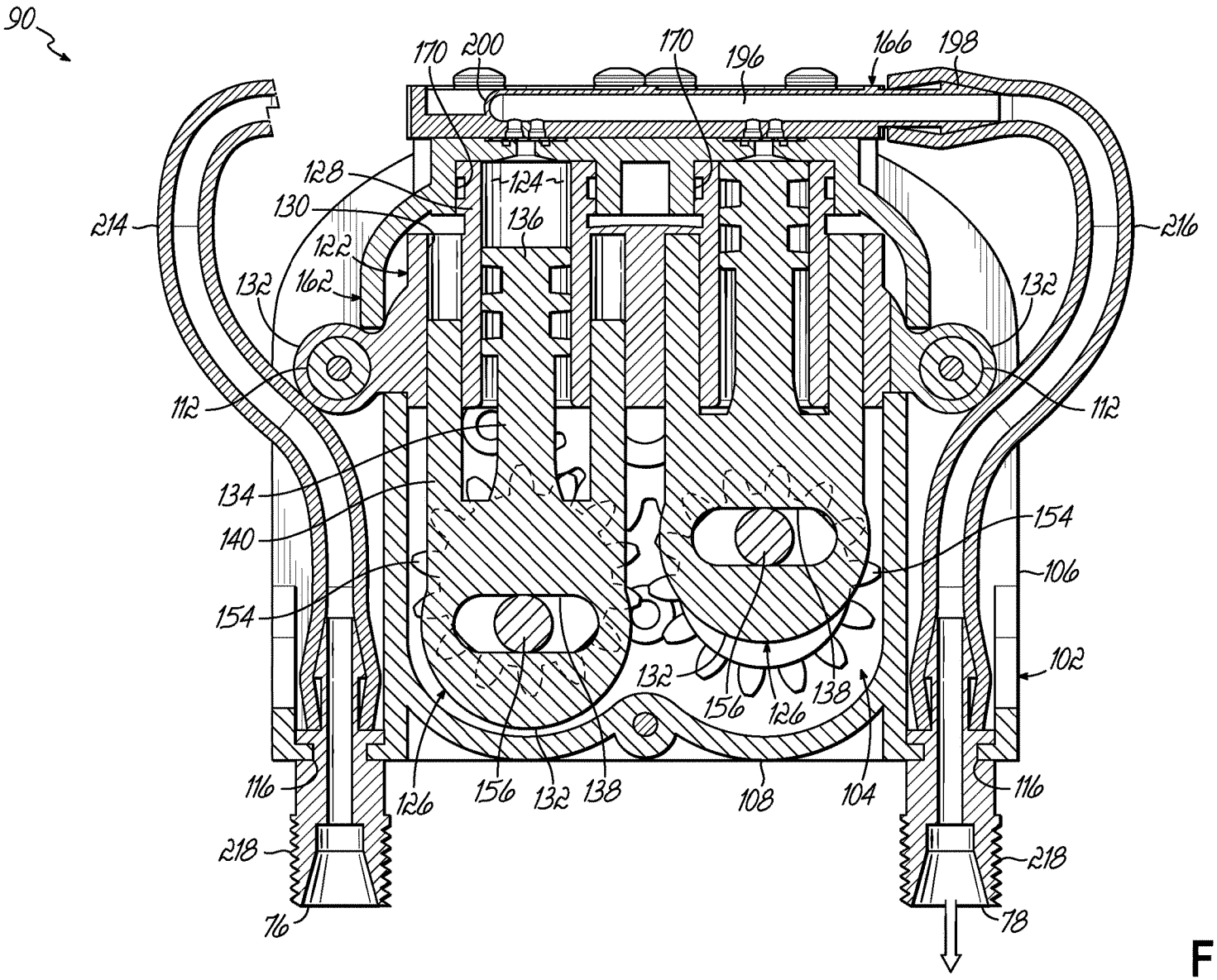
FIG. 7A is a cross-sectional view of the dual-piston pump module illustrating the outflow of chemical product from the pump.

Operation of the pump module 90, once coupled to the chemical dispenser 14 and operational within the chemical dispensing system 10, will now be described. FIGS. 6A-6D illustrate operation of the pump module 90 as it relates to the inflow of chemical product into the pump, and FIGS. 7A-7D illustrate operation of the pump module 90 as it relates to the outflow of chemical product from the pump. For purposes of discussion, the initial configuration of the pump module 90 will be with the left piston 126 in the bottom dead position with the piston chamber 124 full of product, and the right piston 126 in the top dead position with the piston chamber 124 fully evacuated. This configuration is shown in FIGS. 6A and 7A. Activation of the motor 146 (i.e., under the control of controller 34) causes the primary drive gear 152 to rotate, which in turn causes both the secondary drive gears 154 to rotate. With rotation of the secondary drive gears 154, the left piston 126 begins to move upward through a positive pressure stroke and the right piston 126 begins to move downward through a negative pressure stroke (i.e., vacuum).

Figure 7B:
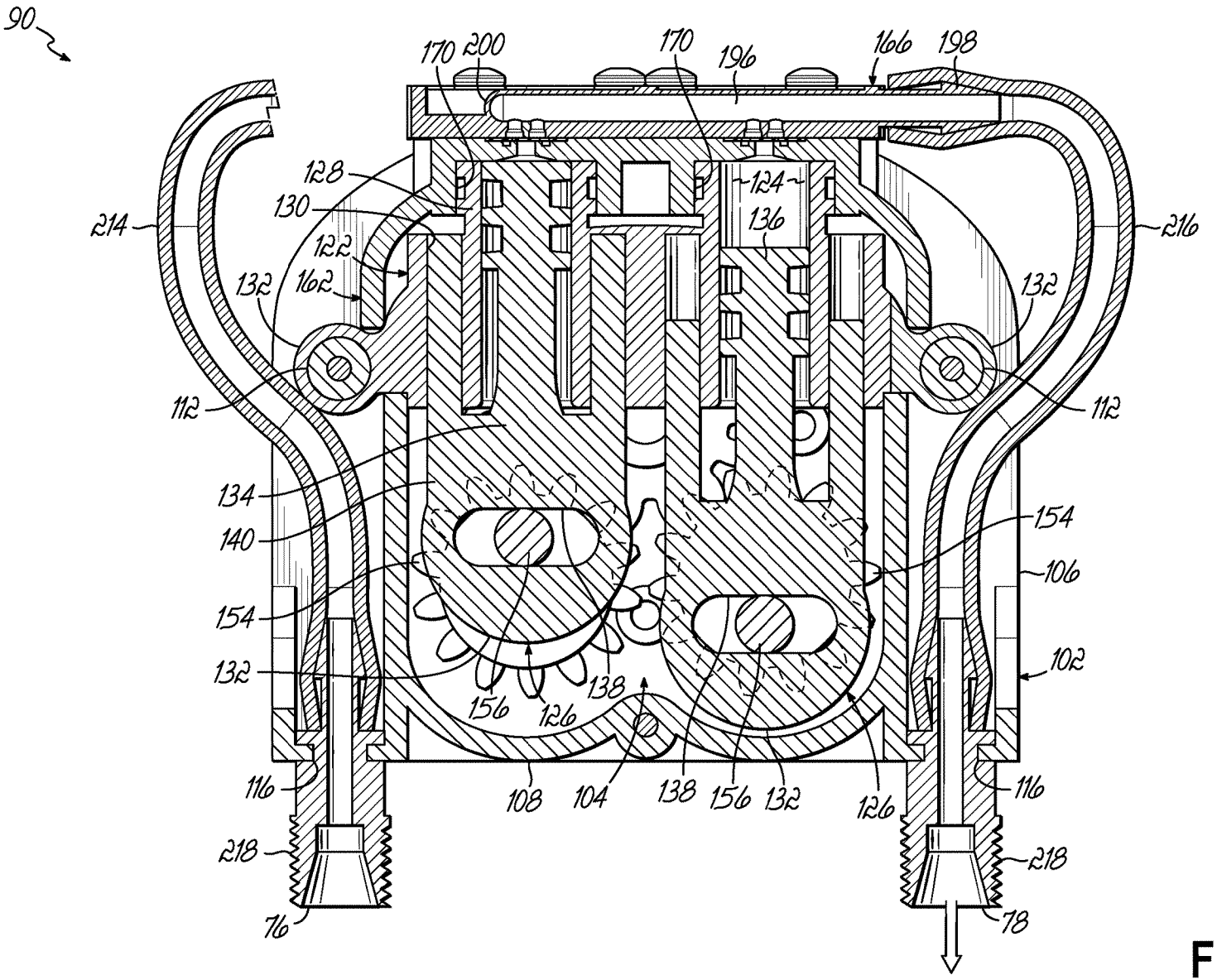
FIG. 7B is another cross-sectional view of the dual-piston pump module illustrating the outflow of chemical product from the pump.
Figure 7C:
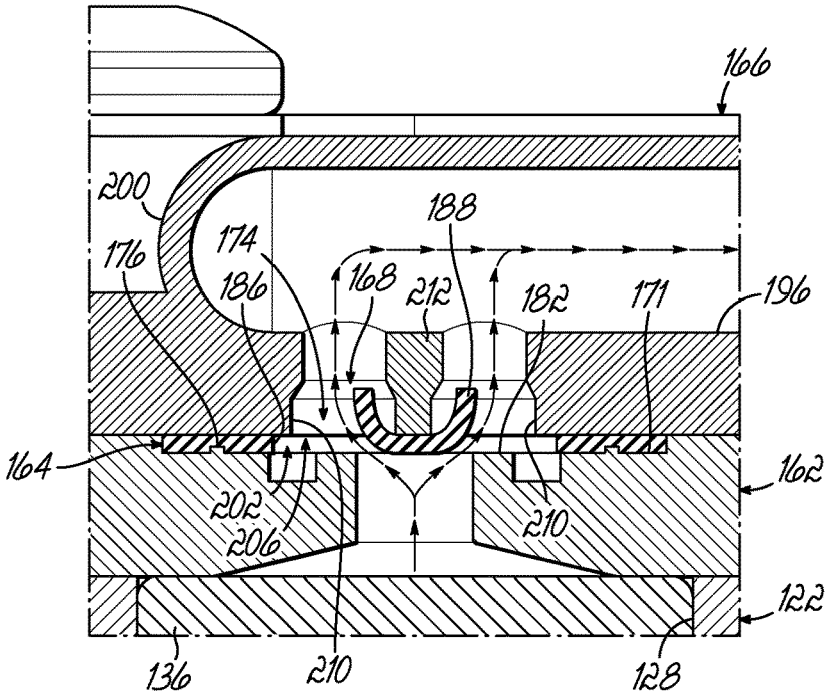
FIG. 7C is an enlarged partial view of the valve arrangement during the outflow of chemical product from the pump.
Figure 7D:
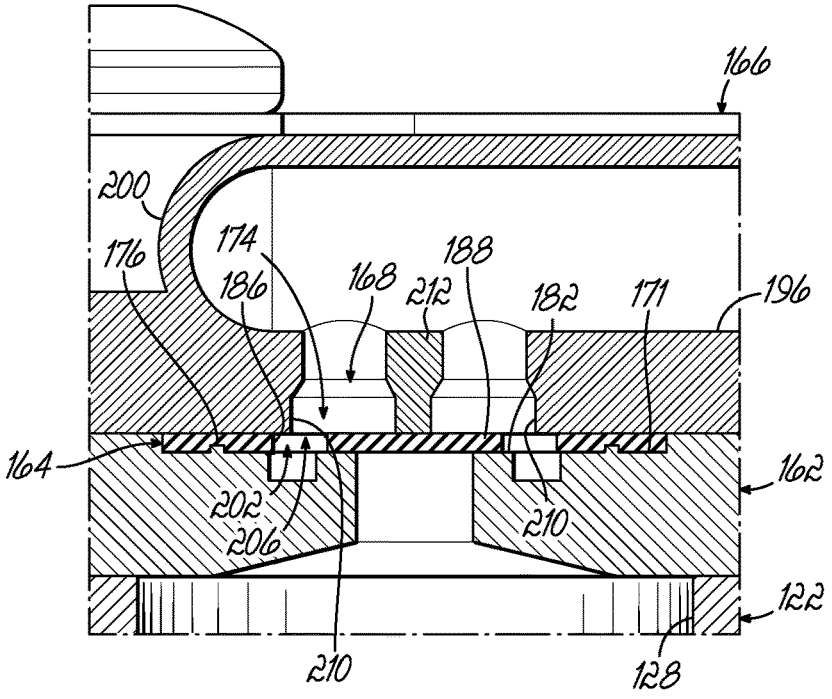
FIG. 7D is another enlarged partial view of the valve arrangement during the outflow of chemical product from the pump.

Focusing first on the left piston, during the positive pressure stroke of this piston, the positive pressure in the piston chamber 124 causes the valve flap 188 associated with the inlet channel 190 to engage against the annular valve seat 208 such that the valve is closed and fluid cannot pass from the piston chamber 124 to the inlet channel 190. This valve configuration for the left piston 126 is illustrated in FIG. 6C, for example. However, the positive pressure in the piston chamber 124 causes the valve flap 188 associated with the outlet channel 196 to deflect away from the valve seat 176 and flex about the valve post 212 to thereby allow the pressurized chemical product in the piston chamber 124 to flow into the outlet channel 196 and to the outlet 78 of the pump module 90 via the outlet tubing 216. This valve configuration for the left piston 126 is illustrated in FIG. 7D, for example.

Turning now to the right piston, during the negative pressure stroke of this piston, the negative pressure in the piston chamber 124 causes the valve flap 188 associated with the inlet channel 190 to deflect away from the valve seat 208 and flex about the valve post 180 to thereby allow the product in the inlet channel 190, which is received from the inlet 76 of the pump module 90 via the inlet tubing 214, to flow into the piston chamber 124. This valve configuration for the right piston 126 is illustrated in FIG. 6D, for example. However, the negative pressure in the piston chamber 124 causes the valve flap 188 associated with the outlet channel 196 to engage against the annular valve seat 176 such that the valve is closed and fluid cannot pass from the piston chamber 124 to the outlet channel 196. This valve configuration for the right piston 126 is illustrated in FIG. 7C, for example.

The left piston 126 continues to eject chemical product from the piston chamber 124 to the outlet channel 196, and the right piston continues to pull chemical product into the piston chamber 124 from the inlet channel 190 until the left and right pistons 126 substantially reach their top dead position and bottom dead position, respectively. This configuration of the pump module 90 is shown in FIGS. 6B and 7B. At this point, the pistons 126 change direction with further activation of the motor 146 such that the left piston 126 begins to move downward through a negative pressure stroke and the right piston 126 begins to move upward through a positive pressure stroke.

For the left piston, during the negative pressure stroke of this piston, the negative pressure in the piston chamber 124 causes the valve flap 188 associated with the inlet channel 190 to deflect away from the valve seat 208 and flex about the valve post 180 to thereby allow the product in the inlet channel 190 to flow into the piston chamber 124. This valve configuration for the left piston 126 is illustrated in FIG. 6D, for example. However, the negative pressure in the piston chamber 124 causes the valve flap 188 associated with the outlet channel 196 to engage against the annular valve seat 176 such that the valve is closed and fluid cannot pass from the piston chamber 124 to the outlet channel 196. This valve configuration for the right piston 126 is illustrated in FIG. 7C, for example.

For the right piston, during the positive pressure stroke of this piston, the positive pressure in the piston chamber 124 causes the valve flap 188 associated with the inlet channel 190 to engage against the annular valve seat 208 such that the valve is closed and fluid cannot pass from the piston chamber 124 to the inlet channel 190. This valve configuration for the left piston 126 is illustrated in FIG. 6C, for example. However, the positive pressure in the piston chamber 124 causes the valve flap 188 associated with the outlet channel 196 to deflect away from the valve seat 176 and flex about the valve post 212 to thereby allow the pressurized product in the piston chamber 124 to flow into the outlet channel 196. This valve configuration for the right piston 126 is illustrated in FIG. 7D, for example.

The right piston 126 continues to eject product from the piston chamber 124 to the outlet channel 196, and the right piston continues to pull product into the piston chamber 124 from the inlet channel 190 until the left and right pistons 126 substantially reach their bottom dead position and top dead position, respectively. This configuration of the pump module 90 is shown in FIGS. 6A and 7A. At this point, the pistons 126 change direction with further activation of the motor 146 such that the cycle described above repeats itself and product continues to be drawn into the pump module 90 and expelled from the pump module 90 in a substantially continuous and constant fashion.

The dual-piston arrangement of the pump module 90 provides a number of advantages. For example, it is believed that the valves 164 and the seals associated with the pistons 126 (e.g., the O-rings) will generally have a long operating life such that maintenance on the pump module 90 will be significantly reduced. By way of example, it is believed that the dual-piston pump module 90 may operate around 200% longer than current peristaltic pump designs. This is significant in both costs and down time for the chemical dispensing system. Additionally, the dual-piston arrangement provides a generally constant flow of chemical product from the pump during operation. This is in contrast to many types of pumps which may have generally non-continuous output cycles (e.g., step function output cycles). This may be important because of the amount of time in which to pump a chemical product to the washing machine may be relatively short. Because of the near constant flow of chemical product from the pump module 90, a smaller pump may be utilized for achieving the desired amount of chemical product for delivery to the washing machine.

FIGS. 8-13B illustrate an improved pump module 240 in accordance with an embodiment of the invention. The pump module 240 is another type of module 66 used in the chemical dispenser 14 described above. In accordance with an aspect of the invention, the pump module 240 may be configured as a double-ended piston pump capable of relatively constant fluid flow over fairly short cycle times. The pump module 240 is also configured to be low maintenance and capable of very long run times before any maintenance operations are necessary to ensure the accurate dispensing of chemical product from the chemical dispenser 14. This further reduces the maintenance costs and down time for the chemical dispensing system 10.

Figure 8:
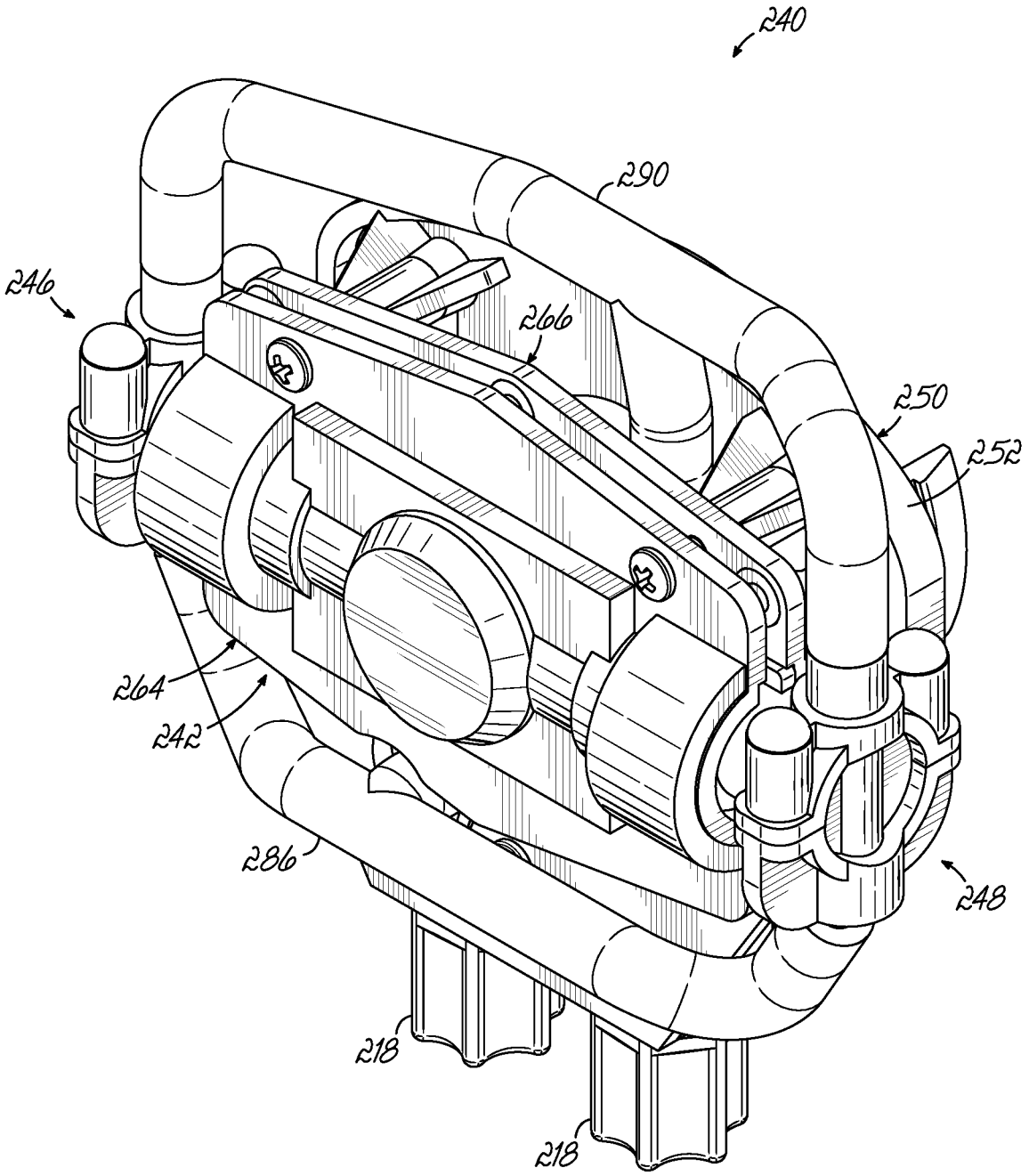
FIG. 8 is a perspective view of a double-ended piston pump module in accordance with an embodiment of the present invention.
Figure 9:
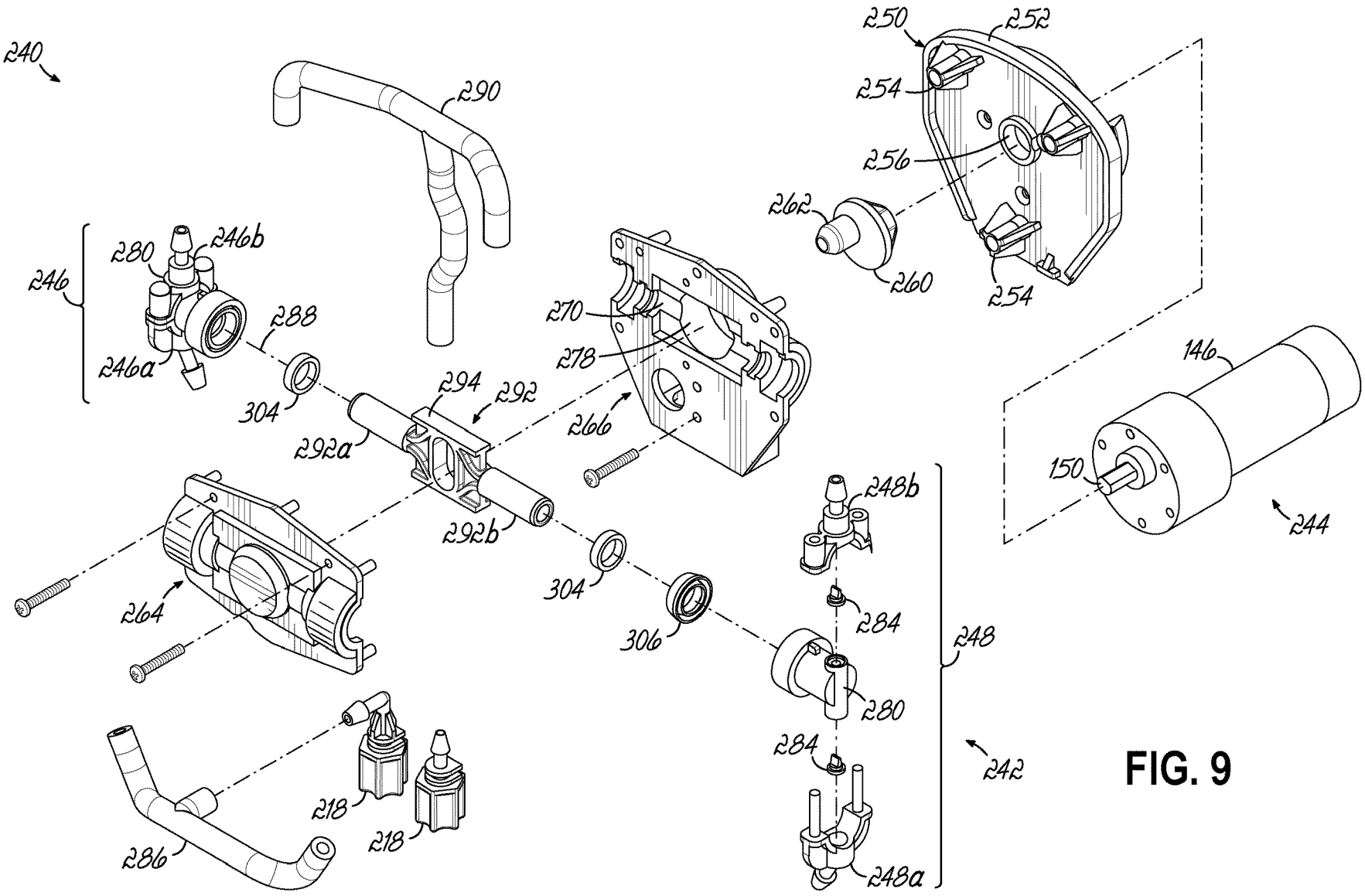
FIG. 9 is a disassembled perspective view of the pump module shown in FIG. 8.

To those and other ends, the exemplary pump module 240 of FIG. 8 in accordance with an embodiment of the invention is shown disassembled in FIG. 9. As is shown and more specifically described below, the pump module 240 operates with a pumping action in a horizontal orientation rather than in a vertical orientation as is shown and described with reference, for example, to the pump module 90 shown in FIG. 5. The pumping action, however, is not restricted to horizontal as all orientations of the piston are contemplated. While not shown, the pump module 240 includes a module housing, such as the module housing 92, shown in FIG. 5, which generally defines the cavity 118 to cover the internal components of the pump module 240.

The internal components of the pump module 240 include a piston assembly 242, a drive assembly 244, and valve assembly 246, 248. While a front housing portion is not shown in FIG. 9, the front housing portion 100 shown in FIG. 5 may be utilized in conjunction with a rear housing portion 250 which fit together to form the housing 92 with the interior 104 for housing the components of the piston assembly 242. The rear housing portion 250 provides a generally planar wall 252 from which spindles 254 extend for mounting the piston assembly 242. A drive aperture 256 is located in the wall 252 relative to the spindles 254 and receives the drive shaft 150 of the motor 146. On the drive shaft 150, a connecting shaft 260 is secured. The connecting shaft 260 is generally circular and receives the drive shaft 150 at its center. An eccentrically located pin 262 extends from a face of the connecting shaft 260 opposite the drive shaft 150. Rotation of the drive shaft 150 rotates the connecting shaft 260 with the pin 262 tracing a circular path defined by the offset between the axis of the drive shaft 150 and the axis of the pin 262. The circular path traced by the pin 262 energizes the piston assembly 242 as is further described below with reference to FIGS. 12-13B.

Figure 12:
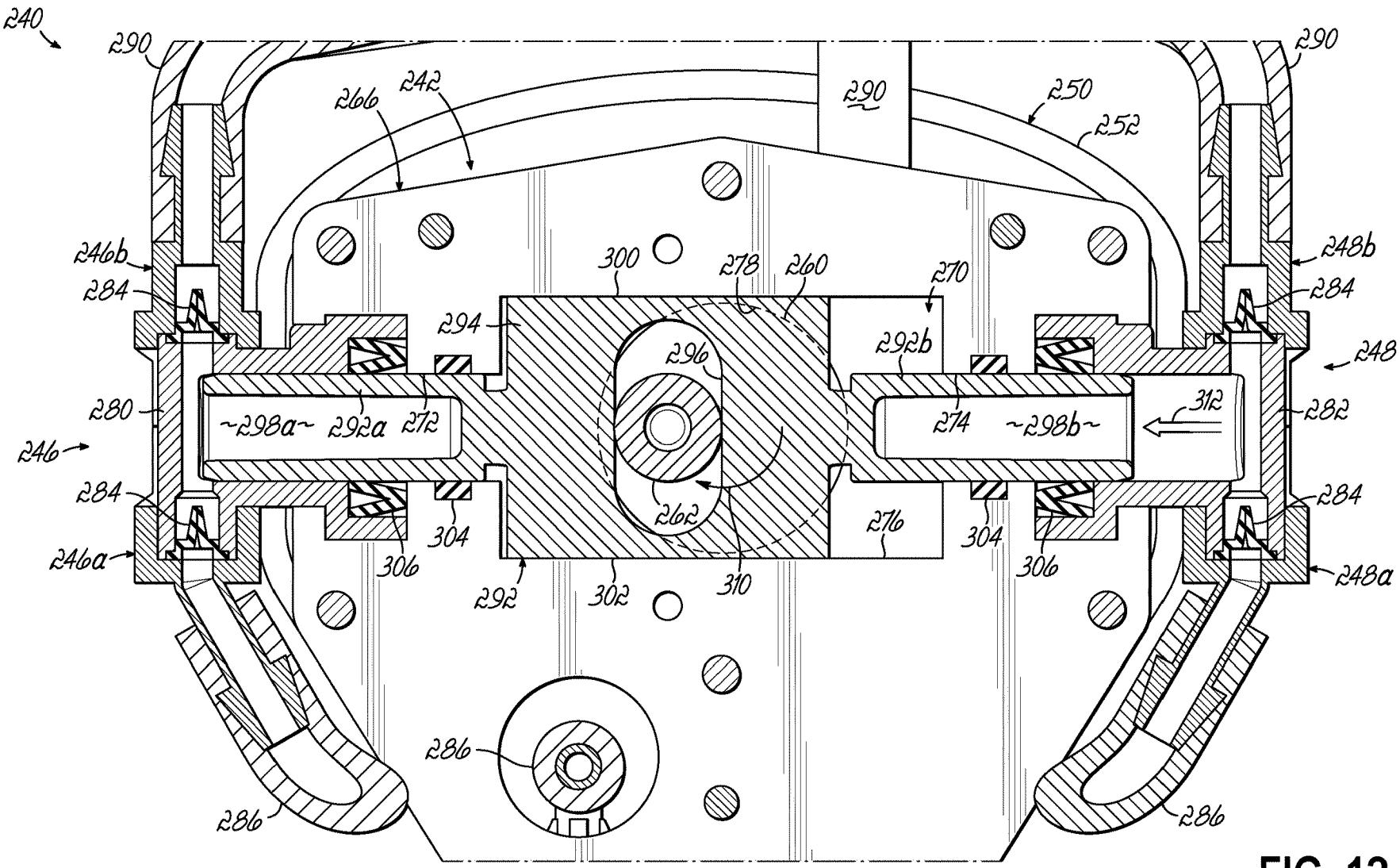
FIG. 12 is a cross-sectional view of the pump module shown in FIG. 8 illustrating lateral movement of the piston.

With continued reference to FIGS. 9 and 12, front and rear piston chamber housings 264, 266 are assembled together and cooperate to form a piston chamber 270. The piston chamber 270 may be symmetrically formed about a mid-plane of the housings 264, 266. The housings 264, 266 define cylinder walls in the piston chamber 270 so as to form a left cylinder 272 opposing a right cylinder 274 separated by a yoke cavity 276 (labeled in FIG. 12). Unlike the module 90, for example, shown in FIG. 5, the piston assembly 242 has only two piston cylinders 272 and 274 that lie along a common longitudinal axis. That is, the piston assembly 242 does not include more or have less than two cylinders. In the yoke cavity 276, there is an opening 278 in the rear piston chamber housing 266 that receives the connecting shaft 260. In this way, the pin 262 extends into the piston chamber 270 to mechanically drive a piston.

In the exemplary embodiment shown, and with reference to FIGS. 9 and 12, portions of each cylinder 272 and 274 are defined by corresponding cylinder heads 280, 282. As can be appreciated from FIG. 9, the cylinder heads 280, 282 are received between the front and rear piston chamber housing 264 and 266. Fastening the front housing 264 and rear housing 266 together via fasteners, such as by the screws shown, secures the cylinder heads 280, 282 in a fixed position at each end of the piston chamber 270. In the exemplary embodiment, the cylinder heads 280, 282 together with the housing 264, 266 define cylinders 272 and 274.

Fluid flow is directed to and from the cylinder 272 and 274, as is described below, via valve assemblies 246, 248, which are coupled to corresponding cylinder heads 280, 282. As shown, each valve assembly 246, 248 includes an inlet valve housing 246*a*, 248*a* and an outlet valve housing 246*b*, 248*b*. Inlet tubing 286 and outlet tubing 290 are connected to respective valve assemblies 246, 248 for directing fluid to/from the piston assembly 242. A plurality of valves 284 are captured between housings 246*a*, 246*b*, 248*a*, and 248*b* corresponding cylinder head 280, 282. Each valve 284 controls fluid flow in a predetermined direction during operation of the piston assembly 242. In the exemplary embodiment shown, the valves 284 are duckbill valves. However, embodiments of the invention are not limited to duckbill valves, as other one-way fluid flow valves may be utilized in accordance with embodiments of the invention.

Figure 10:
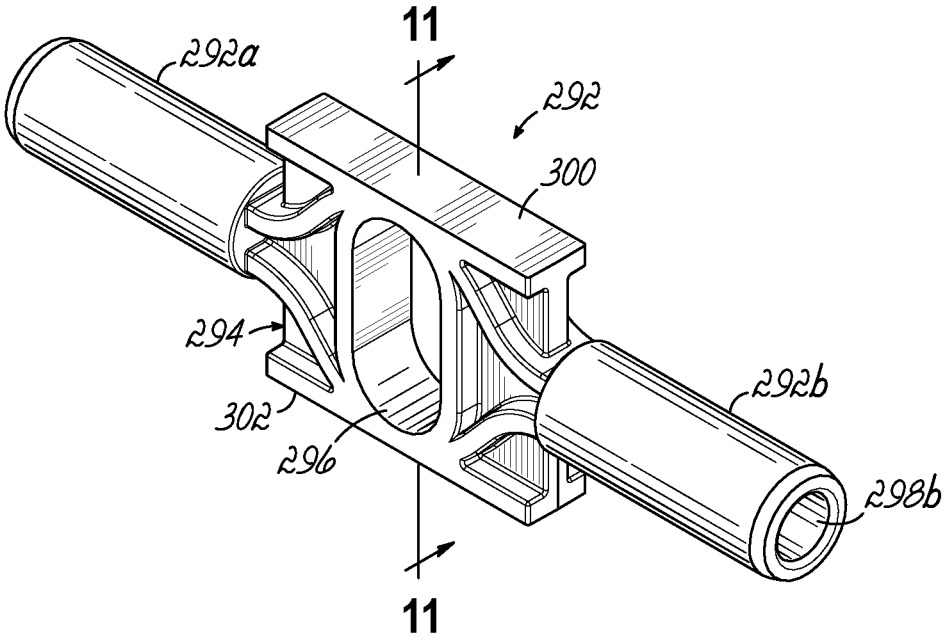
FIG. 10 is a perspective view of a piston of the pump module shown in FIG. 9.
Figure 11:
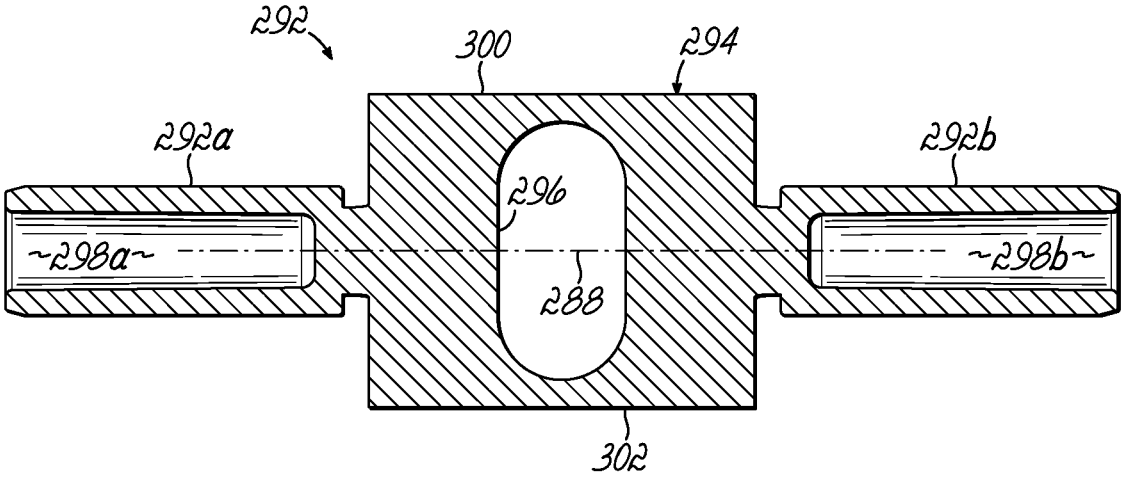
FIG. 11 is a cross-sectional view of the piston of FIG. 10 taken along section line 11-11.

With reference to FIGS. 9, 10, and 11, a piston 292 is movably received between housings 264 and 266 in the piston chamber 270. The piston 292 is shown best in FIGS. 10 and 11 and has a left piston head 292*a* and a right piston head 292*b*, which are received in the left and right cylinders 272, 274, respectively. The piston 292 is referred to as a double-ended piston because it has two working heads. As described, a single cycle of the piston 292 produces two chemical product exhausts from the module 240 and two chemical product intakes into the module 240. The piston head 292*a* and the piston head 292*b* extend from a sliding yoke 294, which is movably received in the yoke cavity 276. The yoke cavity 276 is larger in the horizontal direction that the corresponding width of the sliding yoke 294 but is only slightly larger than the sliding yoke 294 in the vertical or height direction. With these relative dimensions, the piston 292 is capable of moving side-to-side. In the exemplary embodiment shown, the piston head 292*a* and the piston head 292*b* lie on a longitudinal axis 288. The piston may be symmetrical about a plane that intersects the longitudinal axis 288 and about a plane that divides the over length in half. An elliptical slot 296 in the sliding yoke 294 receives the pin 262 of the drive assembly 244 when the piston 292 is contained in the piston chamber 270.

Rotation of the pin 262 about a center of the connecting shaft 260 causes the pin 262 to frictionally engage the elliptical slot 296 as the pin 262 rotates along a path defined by its eccentricity. This eccentric rotation of the pin 262 is transmitted to the piston 292, which reciprocates along a linear path, i.e., in a side-to-side motion by a distance determined by the eccentricity of the pin 262. In the exemplary embodiment, that motion is horizontal relative to the vertical movement of the pistons 126 in embodiment of the pump module 90 shown in FIG. 5, for example. Lower and upper slide rails 300, 302 of the sliding yoke 294 may contact and slide in cooperation with adjacent surfaces of the yoke cavity 276 to guide the side-to-side movement of the piston 292 in the cavity 276. Further in that regard, bearings 304 (shown in FIGS. 9 and 12) may slidably engage piston heads 292*a* and 292*b* and may further guide reciprocating motion of the piston 292 in the piston chamber 270 during fluid pumping, described below. By way of example only, and not limitation, bearings 304 may be scarf bearings.

As shown in FIGS. 11 and 12, the piston heads 292*a* and 292*b* may be hollow and open to the corresponding cylinder 272, 274. Advantageously, when the piston 292 is formed as a single-piece molded component, such as from a plastic, the piston heads 292*a* and 292*b* may include hollow end portions 298*a* and 298*b*. This design permits the surface engagement with the cylinders 272 and 274 to be of more precise dimensional tolerance and reduces gaps in the fit between the piston 292 and the cylinders 272, 274. Fluid leakage is thereby reduced while pumping efficiency/accuracy of the pump module 240 is improved. In the exemplary embodiment, head seals 306 are captured between the housings 264 and 266 and a respective one of the cylinder heads 280, 282 to fluidly seal the cylinders 272, 274 from fluid leakage between piston head 292*a*, 292*b*; cylinder heads 280, 282; and housings 264, 266.

Operation of the pump module 240, once coupled to the chemical dispenser 14 and operational within the chemical dispensing system 10, will now be described with reference to FIGS. 12, 12A, and 12B during one lateral motion of the piston 292 and with reference to FIGS. 13, 13A, and 13B during the opposite lateral motion of the piston 292. The two lateral motions are one full cycle of the piston 292. To that end, rotation of the connecting shaft 260 causes the pin 262 to also rotate clockwise, and by its engagement with the sliding yoke 294 at the elliptical slot 296, strokes the piston 292 to the left. While a clockwise rotation of the pin 262 is described, counterclockwise rotation is also contemplated and embodiments of the invention are not limited to either clockwise rotation or counterclockwise rotation.

Clockwise rotation is illustrated in FIG. 12 by arrow 310 for rotation of the pin 262. The clockwise rotation of pin 262 causes the piston 292 to move according to arrows 312 in each of FIGS. 12, 12A, and 12B. With reference to FIG. 12A, lateral motion of the piston 292 (and piston head 292*a*) pushes chemical product in the left cylinder 272 out of the cylinder head 280 and through the valve 284 at the outlet valve housing 246*b*. The valve 284 at this location is a one-way valve that opens to allow fluid flow in the direction of arrows 316. The valve 284 in the inlet valve housing 246*a* is closed and prevents fluid from exiting the cylinder 272 at this location as the piston 292 moves laterally to the left.

Figure 12B:
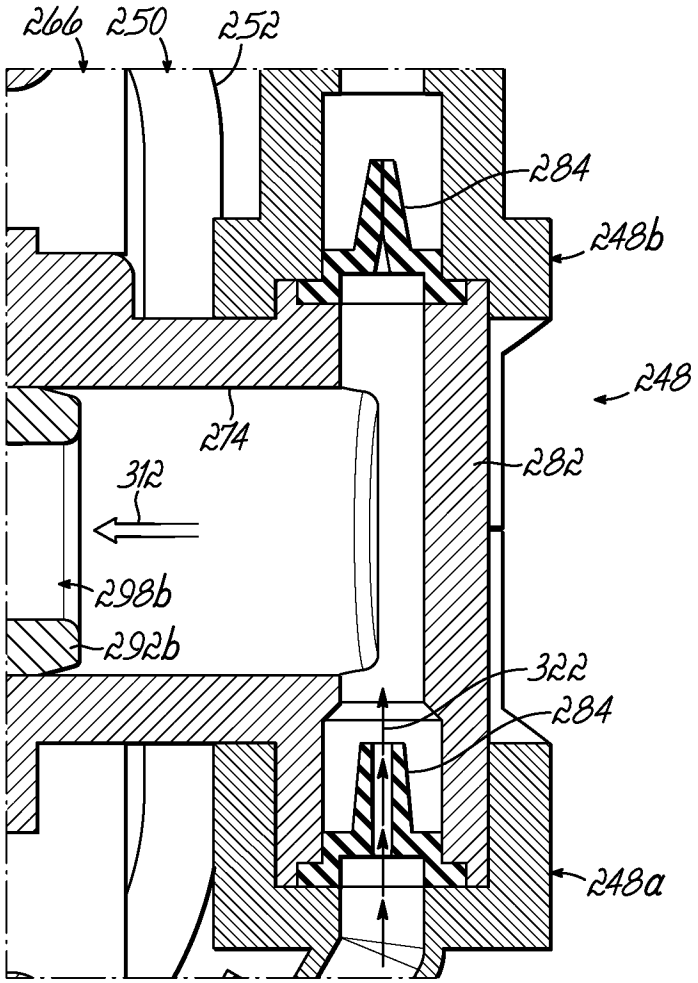
FIG. 12B is an enlarged cross-sectional view of the pump module of FIG. 12 illustrating fluid movement into the other cylinder due to the same piston motion.
Figure 12A:
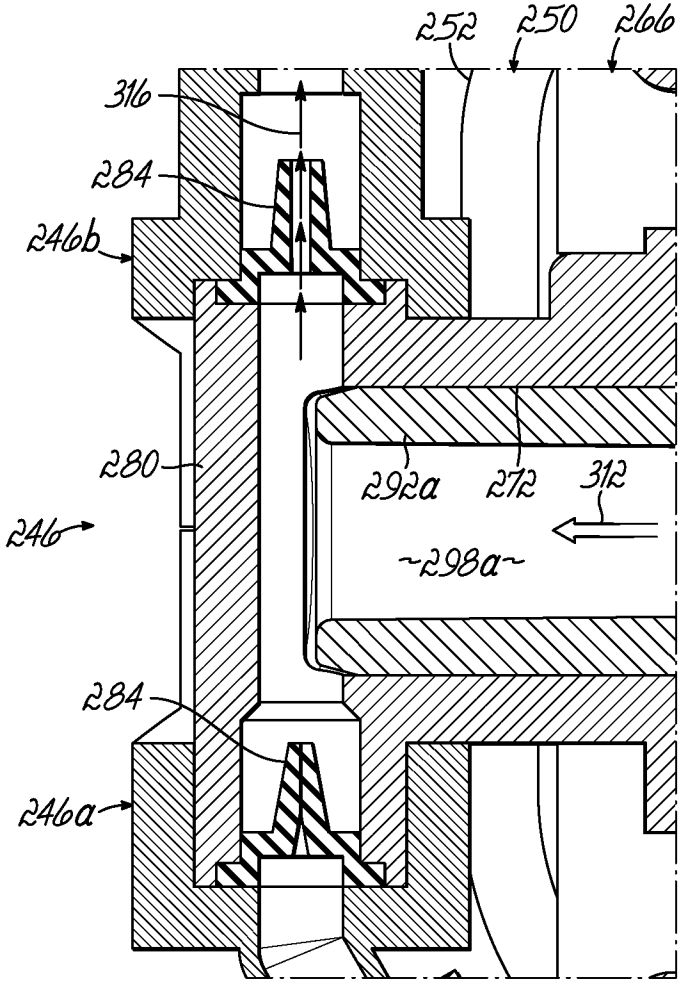
FIG. 12A is an enlarged cross-sectional view of the pump module of FIG. 12 illustrating fluid movement from one cylinder due to piston motion.
Figure 13:
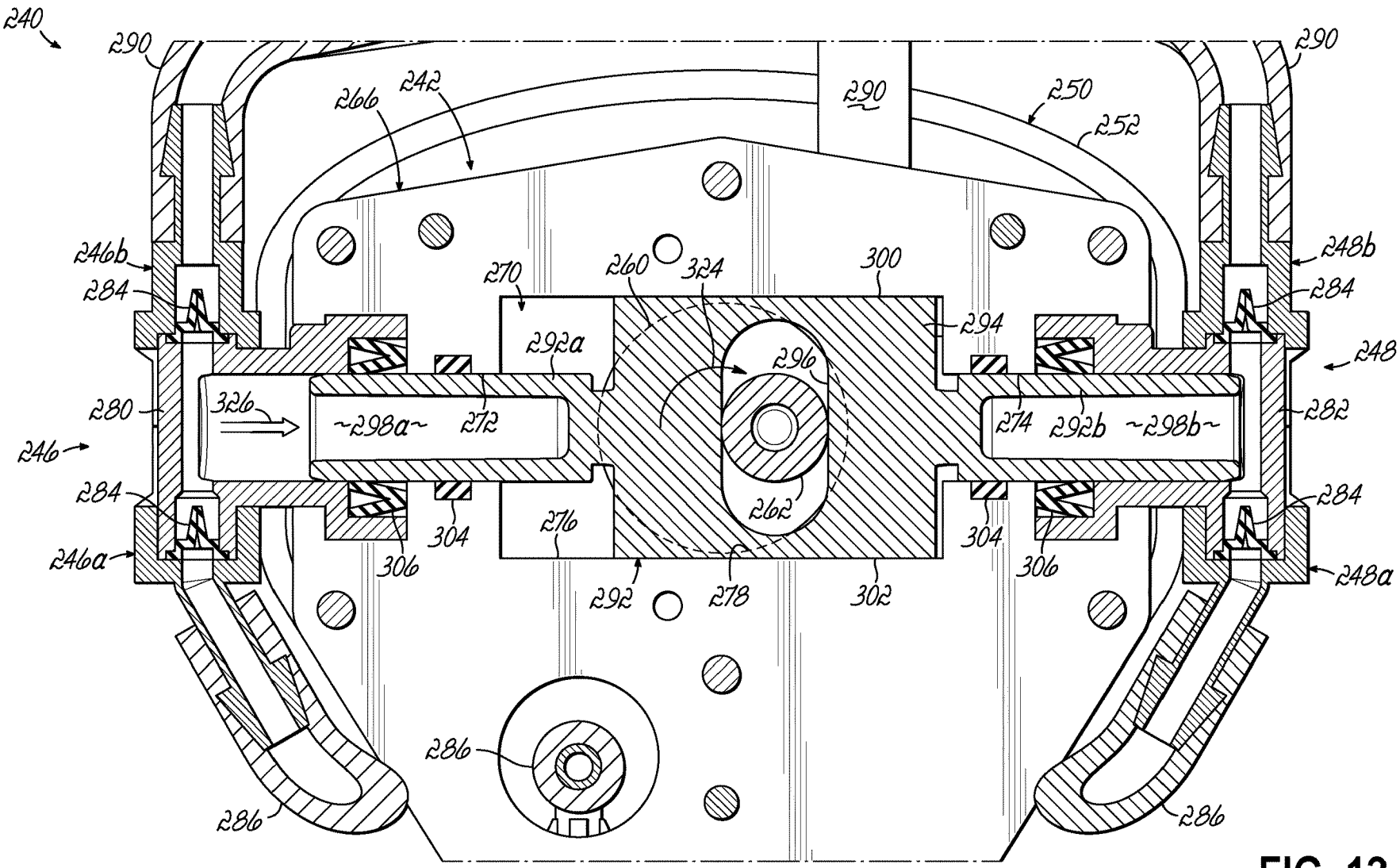
FIG. 13 is a cross-sectional view of the pump module shown in FIG. 8 illustrating lateral movement of the piston.
Figure 13B:
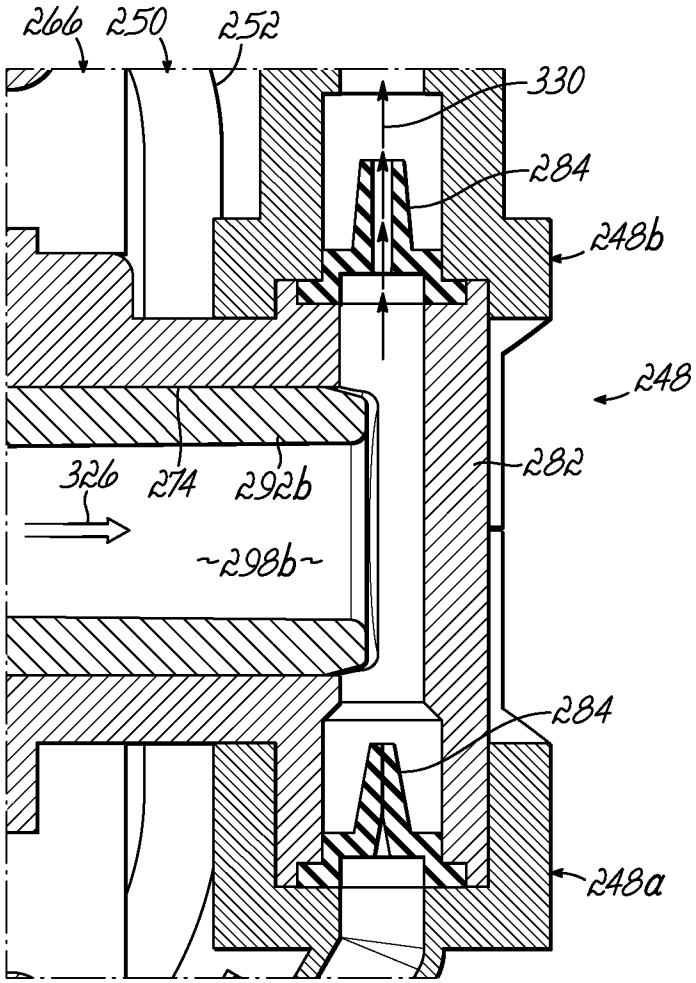
FIG. 13B is an enlarged cross-sectional view of the pump module of FIG. 13 illustrating fluid movement from the other cylinder due to the same piston motion.
Figure 13A:
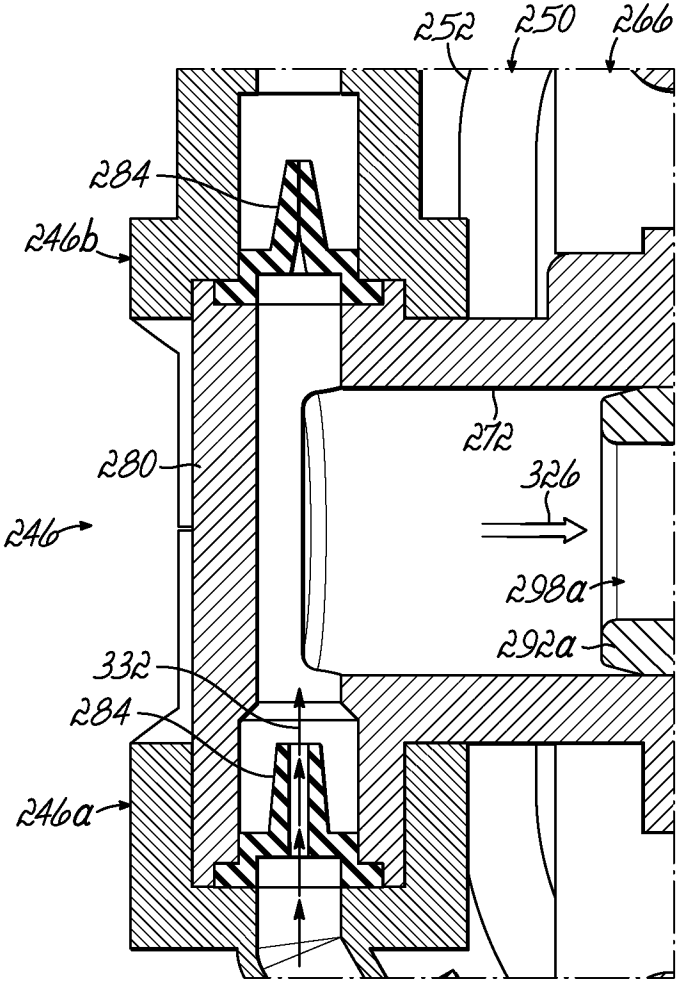
FIG. 13A is an enlarged cross-sectional view of the pump module of FIG. 13 illustrating fluid movement into due to piston motion.

Simultaneously, as the piston 292 strokes laterally to the left and exhausts chemical product from the left cylinder 272, and with reference to FIG. 12B, chemical product is pulled into the right cylinder 274 according to arrow 322 through the valve 284 at the inlet valve housing 248*a*. The valve 284 in the inlet valve housing 248*a* is a one-way valve that opens to allow fluid flow in the direction of arrows 322. The valve 284 in the outlet valve housing 248*b* is closed and prevents fluid from entering the right cylinder 274 at this location as the piston 292 moves laterally to the left. With reference to FIGS. 12A and 12B, chemical product flows out of the left cylinder 272 toward the washing machine 12*a* (FIG. 1), for example, while fluid in drawn into the right cylinder 274 from one of the chemical reservoirs 18*a*, 18*b*, for example.

Continued rotation of the pin 262 in a clockwise direction from the position shown in FIG. 12 continues fluid pumping, but from the right cylinder 274 to the washing machine 12*a*. In that regard, rotation of the connecting shaft 260 further clockwise from the position shown in FIG. 12 to the position shown in FIG. 13 requires that the pin 262 also rotates clockwise. By its engagement with the sliding yoke 294 at the elliptical slot 296, the piston 292 is moved laterally to the right in the piston chamber 270. The clockwise rotation of pin 262 causes the piston 292 to move according to arrows 326 in each of FIGS. 13, 13A, and 13B.

Fluid motion in the left cylinder 272 is described with reference to FIGS. 13 and 13A. Lateral motion of the piston 292 and piston head 292*a* in the left cylinder 272, pulls fluid into the left cylinder 272 according to arrow 332 through the valve 284 at the inlet valve housing 246*a*. The valve 284 in the inlet valve housing 246*a* is a one-way valve that opens to allow fluid flow in the direction of arrows 332. The valve 248 in the outlet valve housing 246*b* is closed and prevents fluid from entering the left cylinder 272 at this location as the piston 292 moves laterally to the right. In this way, fluid fills the left cylinder 272.

Simultaneously, as the piston 292 strokes laterally to the right, it exhausts chemical product from the right cylinder 274 and consequently out of the pump module 240. The fluid exits the right cylinder 274 out of the cylinder head 282 and through the valve 284 at the outlet valve housing 248*b*. The valve 284 at this location is a one-way valve that opens to allow fluid flow in the direction of arrows 330. The valve 284 in the inlet valve housing 248*a* is closed and prevents fluid from exiting the cylinder 274 at this location as the piston 292 moves laterally to the right. With the rotation of the connecting shaft 260, the piston 292 is moved from side-to-side. At one cylinder 272, 274, fluid is expelled from the pump module 240 to downstream equipment, such as the washing machine. At the same time, at the opposite cylinder 272, 274, fluid is drawn in. With this double-ended piston, a single piston cycles provides both chemical product inflow and outflow at each end during one 360° rotation of the drive assembly 244.

The double-ended piston 292 of the pump module 240 is advantageous. For example, it is believed that the valves 284 will generally have a long operating life such that maintenance on the pump module 240 will be significantly reduced. By way of example, it is believed that the double-ended piston pump module 240 may operate around 200% longer than current peristaltic pump designs due to a reduction in the number of moving parts. This is significant in both costs and down time for the chemical dispensing system. Additionally, the double-ended arrangement provides a generally constant flow of chemical product from the pump during operation. The back and forth motion of the piston 292 produces a nearly continuous supply of fluid downstream. Advantageously, because of the double-ended piston design, the timing of fluid motion from left side and right side is constant. There is no need to consider the relative position of each separate piston as in a two separate piston pump. In the embodiment shown in FIG. 9, the timing of the pumping action is fixed at 180 degrees. Moreover, the volume of fluid expelled from the left and right sides is equal.

This is in contrast to many types of pumps which may have generally non-continuous output cycles (e.g., step function output cycles). This may be important because of the amount of time in which to pump a chemical product to the washing machine may be relatively short. Because of the near constant flow of chemical product from the pump module 240, a smaller pump may be utilized for achieving the desired amount of chemical product for delivery to the washing machine.

FIGS. 14-21B illustrate an improved pump module 340 in accordance with an embodiment of the invention. The pump module 340 is one of the types of modules 66 used in chemical dispenser 14 described above. In accordance with an aspect of the invention, the pump module 340 may be configured as a dual-piston pump that is capable of relatively constant fluid flow over fairly short cycle times. The dual-piston pump module 340 is similar in some respects to the dual-piston pump module 90, described above, and is also configured to be low maintenance and capable of very long run times before any maintenance operations are necessary to ensure the accurate dispensing of chemical product from the chemical dispenser 14. This further reduces the maintenance costs and down time for the chemical dispensing system 10.

Figure 15:
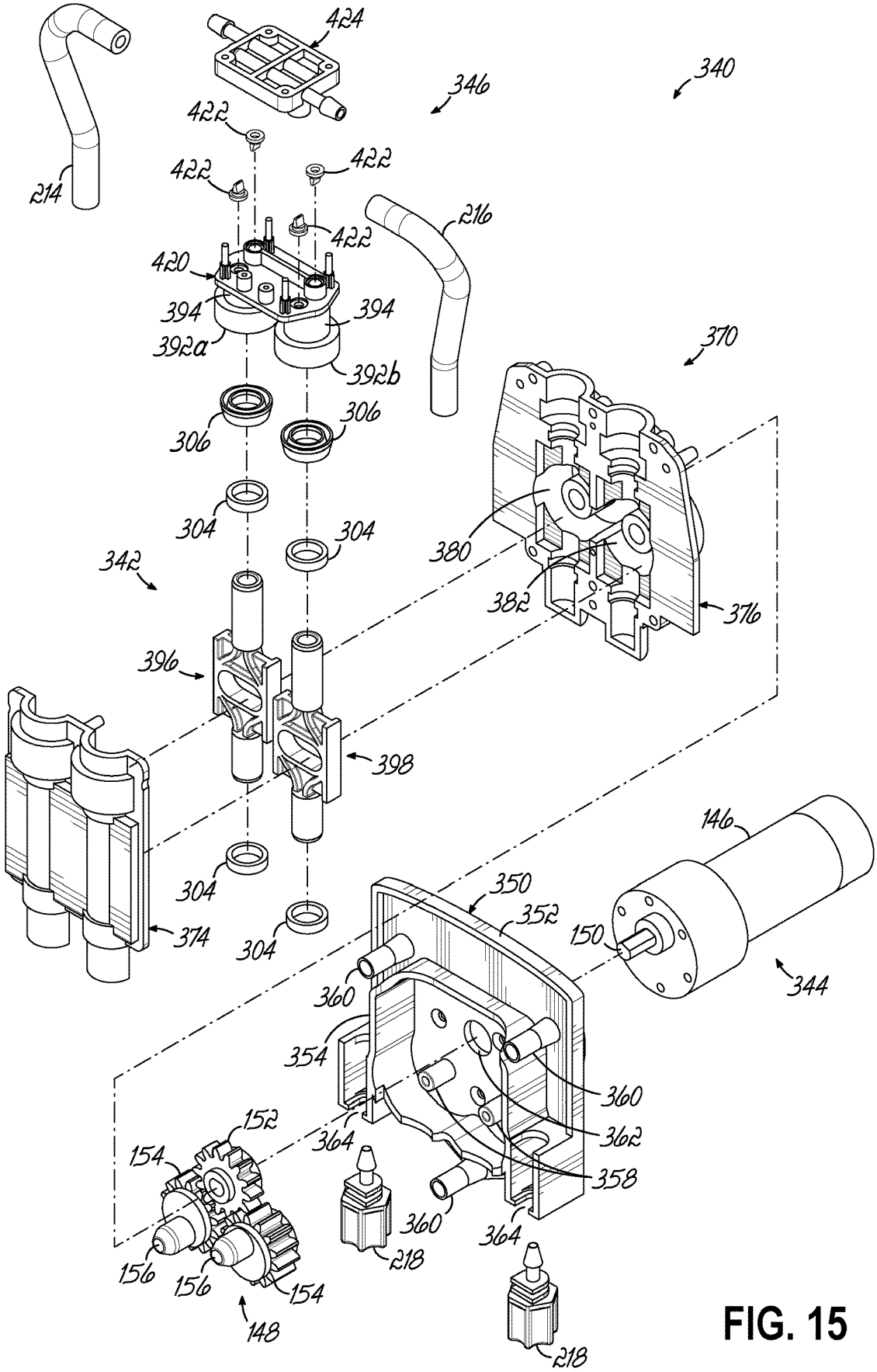
FIG. 15 is a disassembled perspective view of the pump module shown in FIG. 14.

A disassembled dual-piston pump module 340 in accordance with an embodiment of the invention is illustrated in FIG. 15. The dual-piston pump module 340 includes a piston assembly 342, a drive assembly 344, and a valve assembly 346. Although not shown in FIG. 15, the module housing 92 described with the pump module 90 and shown in FIG. 5 may be utilized to house the pump module 340. The rear housing portion 350 includes a generally planar wall 352, a generally U-shaped support or frame 354 extending from an inner surface of the wall 352, a pair of spindles 358 extend from the wall 352 within the U-shaped frame 354, and a trio of support posts 360 extend from the wall 352 outboard of the U-shaped frame 354. The rear housing portion 350 further includes a drive aperture 362 in the wall 352 centrally located above and between the spindles 358 and a pair of slots 364, the purpose of which is described above with regard to the pump module 90, at a lower end of the rear housing portion 350. Although not shown, a front housing portion similar to that shown in FIG. 5 generally defines a cavity and effectively operates as a cover for the internal components of the pump module 340.

Figure 14:
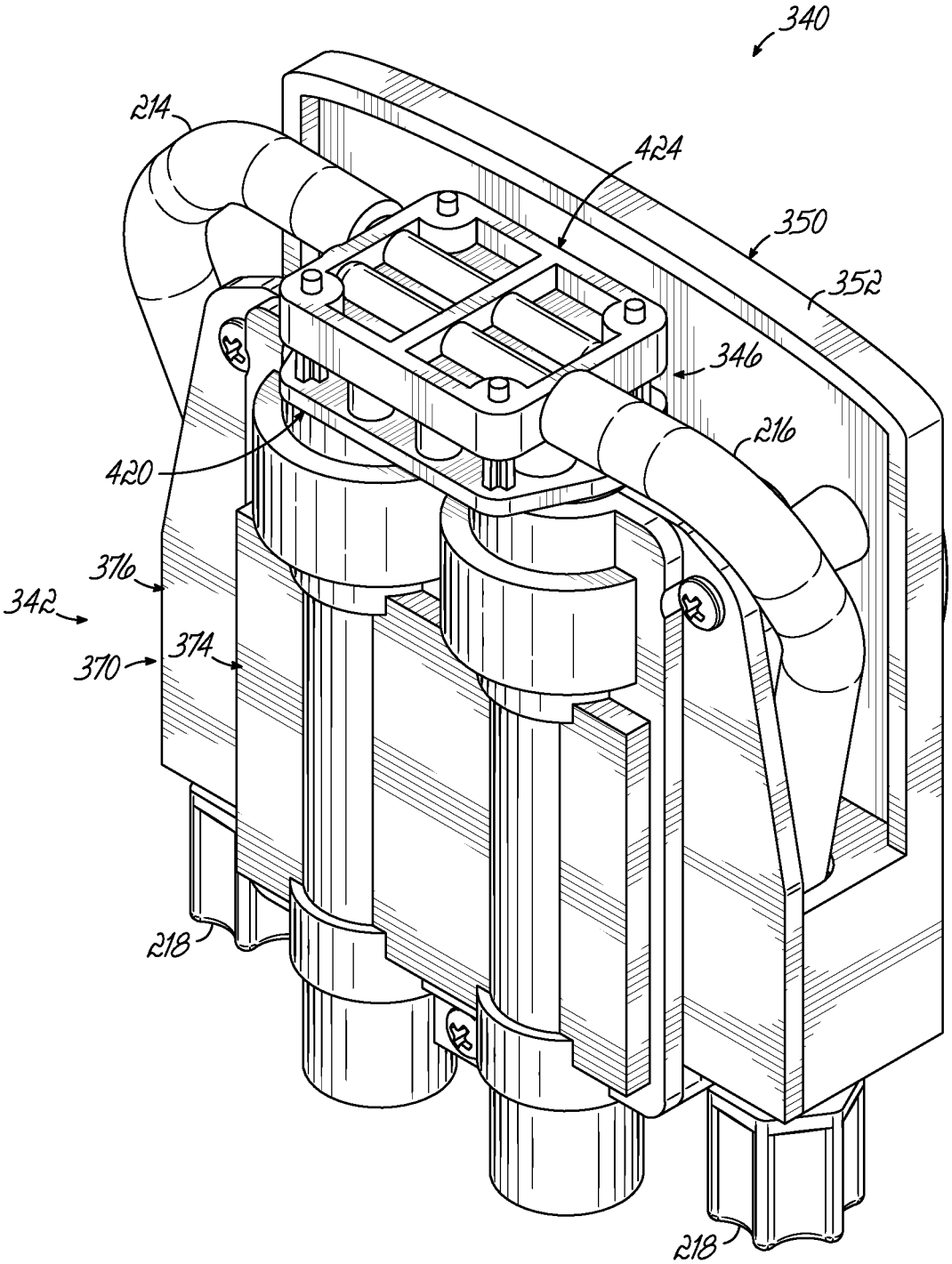
FIG. 14 is a perspective view of a dual-piston pump module in accordance with an embodiment of the present invention.

As illustrated in FIGS. 14 and 15, the piston assembly 342 includes a piston chamber housing 370 secured to the rear housing portion 350. The piston chamber housing 370 defines a pair of piston cavities 380, 382 that movably receive pistons, described below. In the exemplary embodiment shown, the piston chamber housing 370 is composed of two separate half housings 374 and 376 that are secured together via screws or by other means. Each half housing 374 and 376 define cylinder cavities 380 and 382 so that when assembled together, the cylinder cavities 380 and 382 collectively define the right and left piston chambers 372*a*, 372*b*. In that regard, the piston chambers 372*a*, 372*b* define two pairs of upper and lower cylinders 384*a*, 384*b* and 388*a*, 388*b* and left and right yoke cavities 390*a* and 390*b*. Collectively, left cylinders 384*a*, 384*b* and left yoke cavity 390*a* movably receive one piston and, similarly, right cylinder 388*a*, 388*b* and right yoke cavity 390*b* movably receives the other piston.

In the exemplary embodiment, the piston chamber housing 370 includes a pair of cylinder heads 392*a*, 392*b* that are captured between the separate half housings 374 and 376. The cylinder heads 392*a*, 392*b* include cylinder walls 394 that align with the cylinder cavities 380 and 382 and so may form an end portion of each respective cylinder 384*a* and 388*a*. Only one set of cylinders 384*a* and 388*a* (i.e., the upper cylinders) may be formed with cylinder heads 392*a*, 392*b*. Head seals 306 (described with reference to FIG. 9) are captured between the housings 374 and 376 and a respective one of the cylinder heads 392*a*, 392*b* to fluidly seal the cylinders 384*a*, 388*a* from fluid leakage. Although not shown, the cylinder heads 392*a*, 392*b* may fully form one or both the left and right cylinders 384*a*, 388*a*. The set of cylinders 384*b* and 388*b* opposing the cylinders 384*a* and 388*a* may be closed off by the piston chamber housing 370 at 378 (shown best in FIG. 16A) to form a blind bore at that location. Because the cylinders 384*a*, 388*a* are closed off, no fluid enters or exits this portion of the piston chambers 372*a*, 372*b*.

Figure 15A:
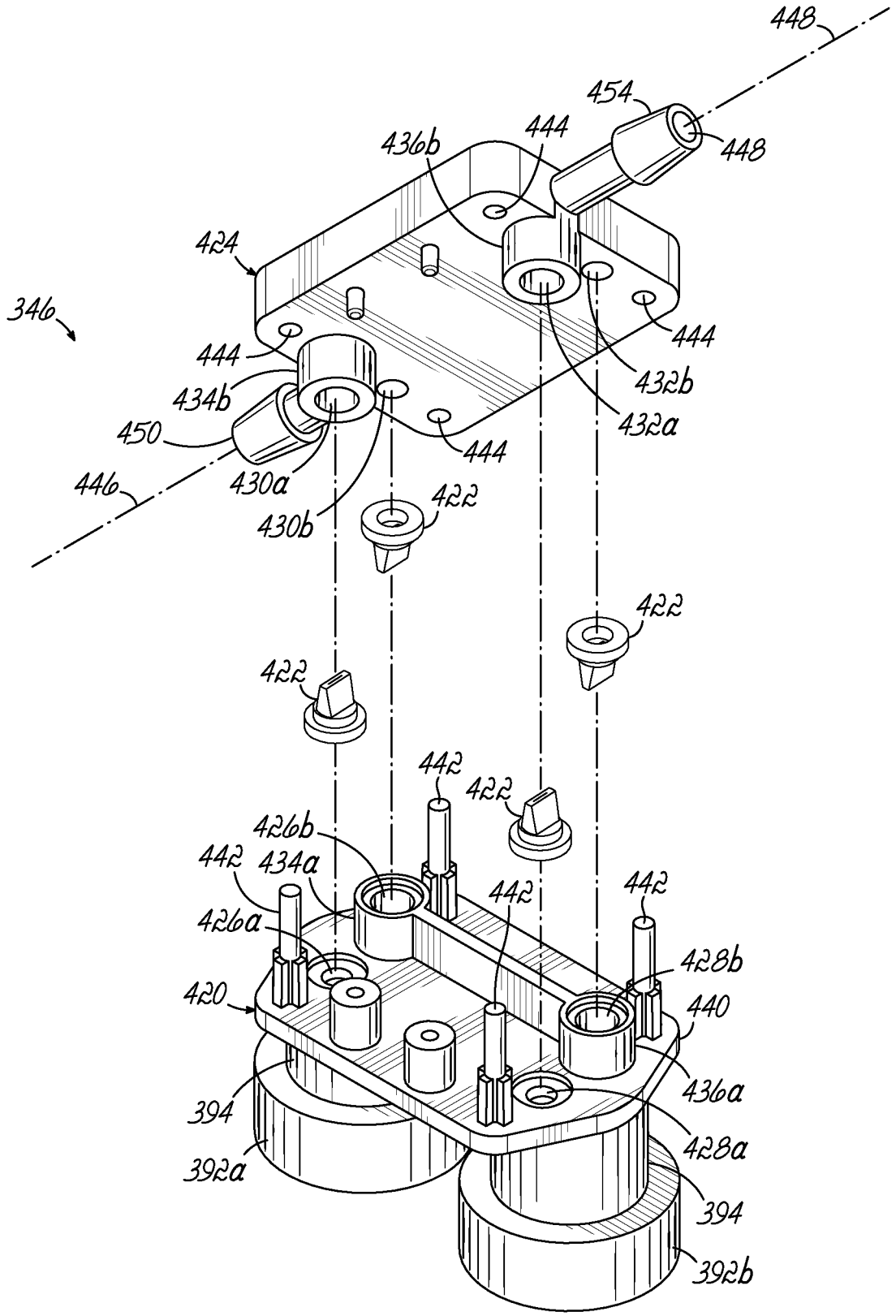
FIG. 15A is a partially disassembled perspective view of a valve assembly for the piston pump module shown in FIG. 14.
Figure 15B:
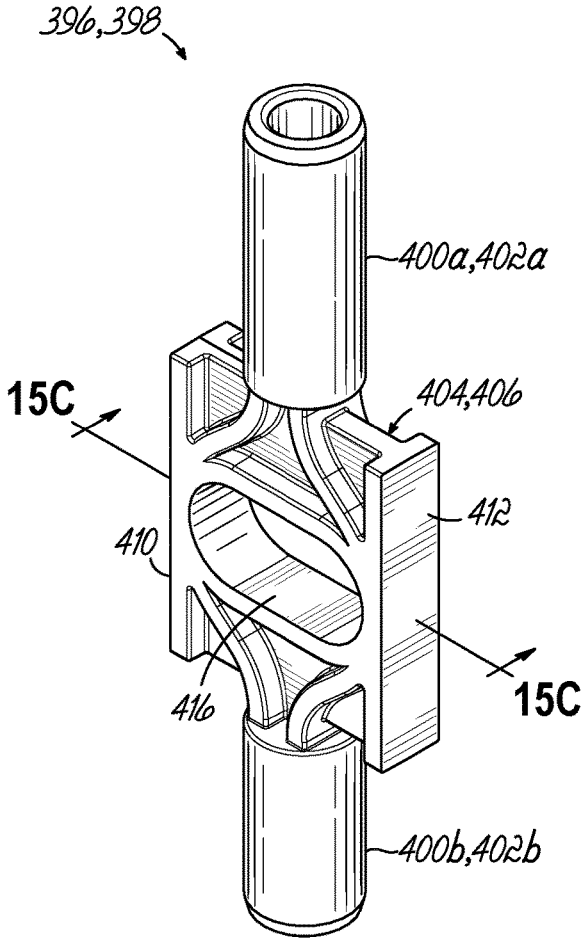
FIG. 15B is a perspective view of a piston of the pump module shown in FIG. 14.
Figure 15C:
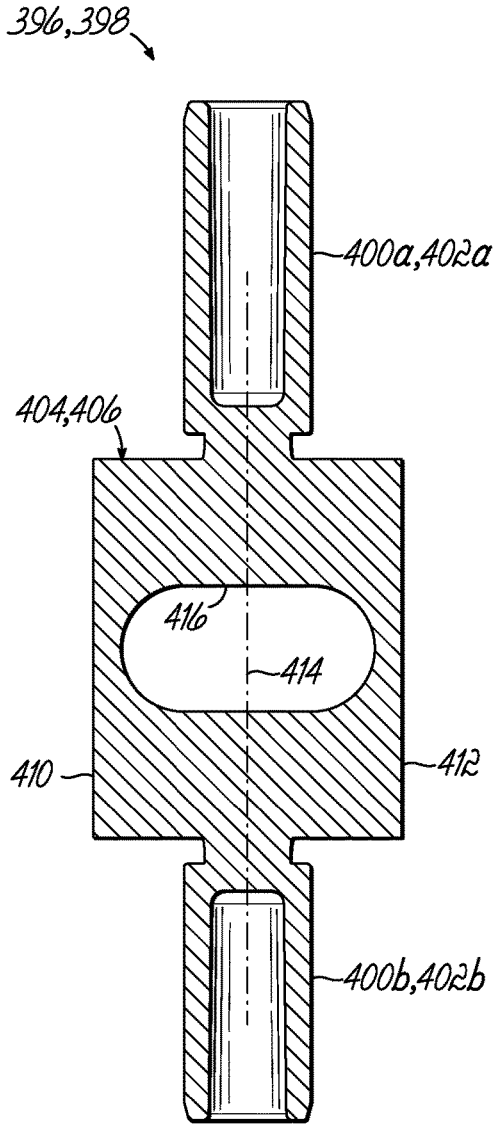
FIG. 15C is a cross-sectional view of the piston of FIG. 15B taken along section line 15C-15C.
Figure 16A:
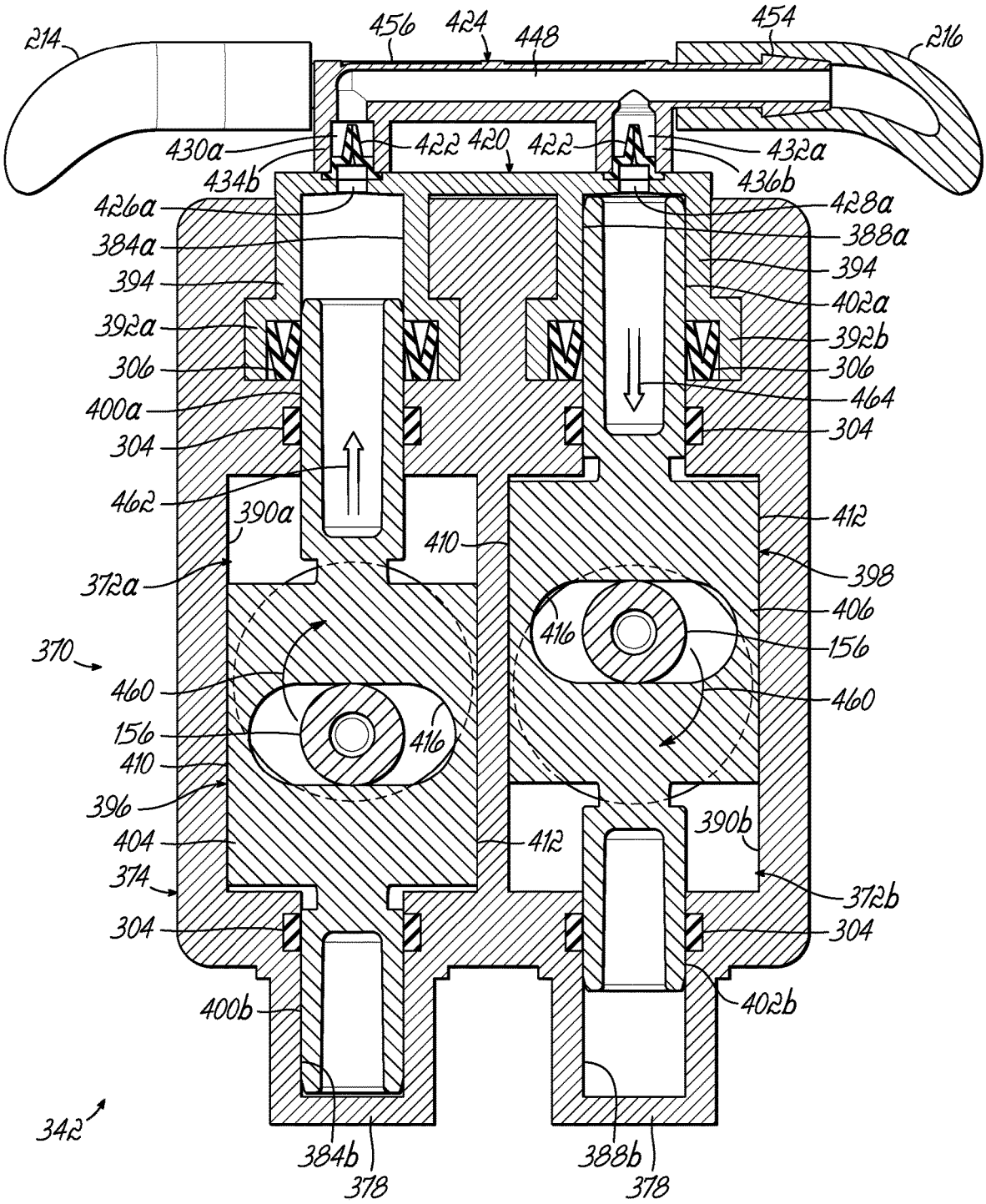
FIG. 16A is a cross-sectional view of the dual-piston pump module illustrating the outflow of chemical product to from pump.

With reference to FIGS. 15, 15B, and 15C, a pair of pistons 396, 398 is movably received within a respective piston chambers 372*a*, 372*b* of the piston chamber housing 370. In the exemplary embodiment shown, each piston 396, 398 is double ended. That is, each piston 396, 398 includes two end portions or heads 400*a*, 400*b* and 402*a*, 402*b* that extend from a sliding yoke 404, 406, respectively, and so are similar to the double-ended piston shown in FIG. 9, for example. However, by contrast, while having two working ends, the pistons 396, 398 pump chemical product at one end, not both. In the exemplary embodiment shown, the piston head 400*a* and the piston head 400*b* lie on a longitudinal axis 414. The piston head 402*a* and the piston head 402*b* also share a separate, common longitudinal axis 414. As shown in FIGS. 15C and 16A, the piston heads 400*a*, 400*b*, 402*a*, 402*b* are hollow and open to the corresponding cylinder 384*a*, 388*a*. This design is advantageous for at least the same reasons identified above with reference to piston 292 shown in FIG. 9. As is shown best in FIG. 15C, each of the heads 400*b* and 402*b* may be shorter in length as measured from the corresponding sliding yoke 404, 406 than the opposing heads 400*a* and 402*a*.

The sliding yokes 404, 406 are each a generally rectangular portion of the piston 396, 398 and may have opposed slide rails 410 and 412. Each sliding yoke 404, 406 is movably received in a respective yoke cavity 390*a*, 390*b* such that the slide rails 410 and 412 frictionally engage corresponding slide surfaces of the yoke cavities 390*a*, 390*b* during movement of the piston 396, 398. This sliding engagement facilitates guided, reciprocating motion of the piston 396, 398 in the respective cavities 380, 382. Additionally, guided engagement is produced between the cylinders 384*b*, 388*b* and a respective one of the pistons 396, 398. While the cylinders 384*b*, 388*b* do not participate in movement of fluid because they are each blind bores, engagement between the cylinders 384*b*, 388*b* and the piston heads 400*b* and 402*b* provides additional alignment to the reciprocating motion. Thus, the double-ended feature of the piston 396, 398 improves alignment between the piston 396, 398 in the opposing cylinders 384*a*, 388*a*. This is advantageous because it improves pumping efficiency and reduces wear. Longevity of the piston assembly 342 is thus increased. To further aid in guiding reciprocating movement of each left cylinder 384*a* and 384*b* and each right cylinder 388*a* and 388*b* includes a bearing 304, described above with reference to FIG. 9. Each sliding yoke 404, 406 includes an elliptical slot 416 which receives one pin 156 of the drive assembly 344 through the piston chamber housing 370, shown in FIG. 15.

As illustrated in FIG. 15, the drive assembly 344 may be substantially identical to the drive assembly 96 described above with reference to FIG. 5. When the motor 146 is energized, the primary drive gear 152 drives the secondary drive gears 154, which in turn cause reciprocating movement of the pistons 396, 398 within their respective piston chambers 372*a*, 372*b*. The use of a dual-piston, double-ended arrangement as a pump, however, involves the coordinated use of a valve arrangement, to which we now turn.

As shown in FIG. 15, the valve assembly 346 is coupled to the cylinder heads 392*a*, 392*b*. The valve assembly 346 includes a valve housing 420, two pairs of valves 422, and a product manifold 424. The valve assembly 346 controls fluid flow into and out of the piston assembly 342. As illustrated in more detail in FIG. 15A, the valve housing 420 includes two pair of fluid ports 426*a*, 426*b* and 428*a*, 428*b* each of which is in fluid communication with a respective one of the valves 422 and a respective one of the cylinders 384*a*, 388*a* via one of the cylinder heads 392*a*, 392*b*. The product manifold 424 includes matching fluid ports 430*a* and 430*b* and 432*a* and 432*b*. The valves 422 are oriented such that one valve permits fluid to enter the cylinder 384*a*, 388*a* and one valve permits fluid to exit the cylinder 384*a*, 388*a*. Similar to the valves 284, shown in FIG. 9, in an exemplary embodiment, the valves 422 are duckbill valves or other one-way flow control valves. In that regard, each valve 422 is seated in a valve housing 434*a*, 434*b* and 436*a*, 436*b*. As shown, valve housings 434*a* and 436*a* extend from a planar support plate 440. And, valve housings 434*b* and 436*b* extend from the product manifold 424. The lateral ends of the planar support plate 440 include a support posts 442 which are received in matching bores 444 in the product manifold 424. When the product manifold 424 and the support plate 440 are assembled, the valves 422 are secured in their respective housings 434*a*, 434*b*, 436*a*, 436*b*.

With continued reference to FIG. 15A, the product manifold 424 provides for chemical product flow to and from the valve assembly 346 and the piston assembly 342. To that end, the product manifold 424 includes an inlet channel 446 having a connector 450 at one end and is closed off at the other end 452 and an outlet channel 448 having a connector 454 at one end and is closed off at the other end 456. The product manifold 424 is configured to be coupled to the cylinder heads 392*a*, 392*b*, as described above. The fluid ports 430*b* and 432*b* are configured to be in selective communication with the inlet channel 446, and the outlet ports 430*a* and 432*a* are configured to be in fluid communication with the outlet channel 448. As further shown in FIGS. 15, 16A, 16B, 17A, and 17B, the valve assembly 346 further includes inlet and outlet tubing 214, 216 extending from their respective connectors 450, 454 to connectors 218 of the pump module 340.

Figure 17B:
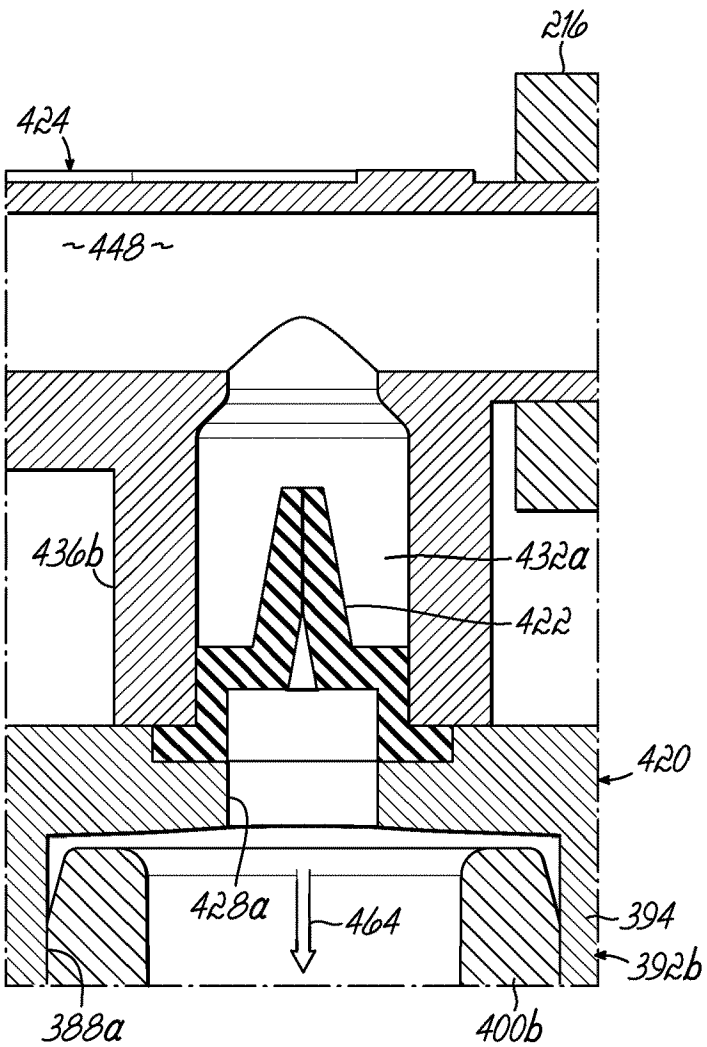
FIG. 17B is another enlarged partial view of the valve arrangement during the outflow of chemical product from the pump.
Figure 17A:
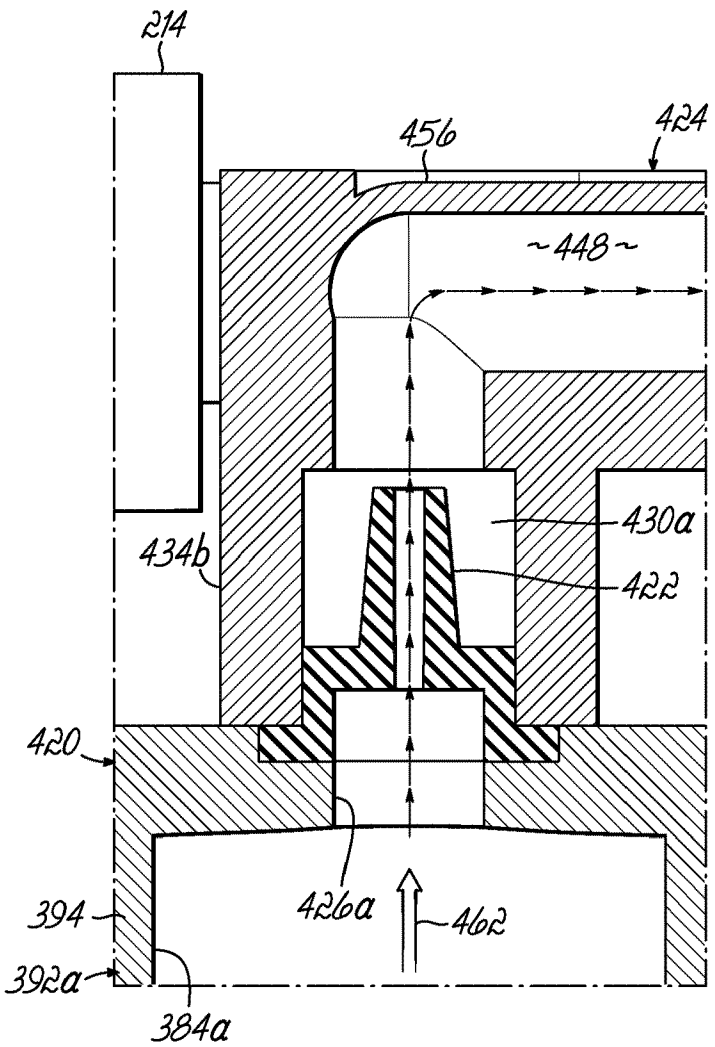
FIG. 17A is an enlarged partial view of the valve assembly during the outflow of chemical product from the pump.

As is illustrated in FIGS. 16A, 17A, and 17B, when the piston assembly 342, the valve assembly 346, and the product manifold 424 are coupled together, the outlet channel 448 is in fluid communication with each of the left cylinder 384*a* and the right cylinder 388*a* through a respective one of the valves 422. Thus, each cylinder 384*a* and 388*a* has associated therewith an outlet port 426*a*, 428*a* and 430*a*, 432*a* for allowing chemical product out of the cylinder 384*a*, 388*a* and into the outlet channel 448.

Figure 16B:
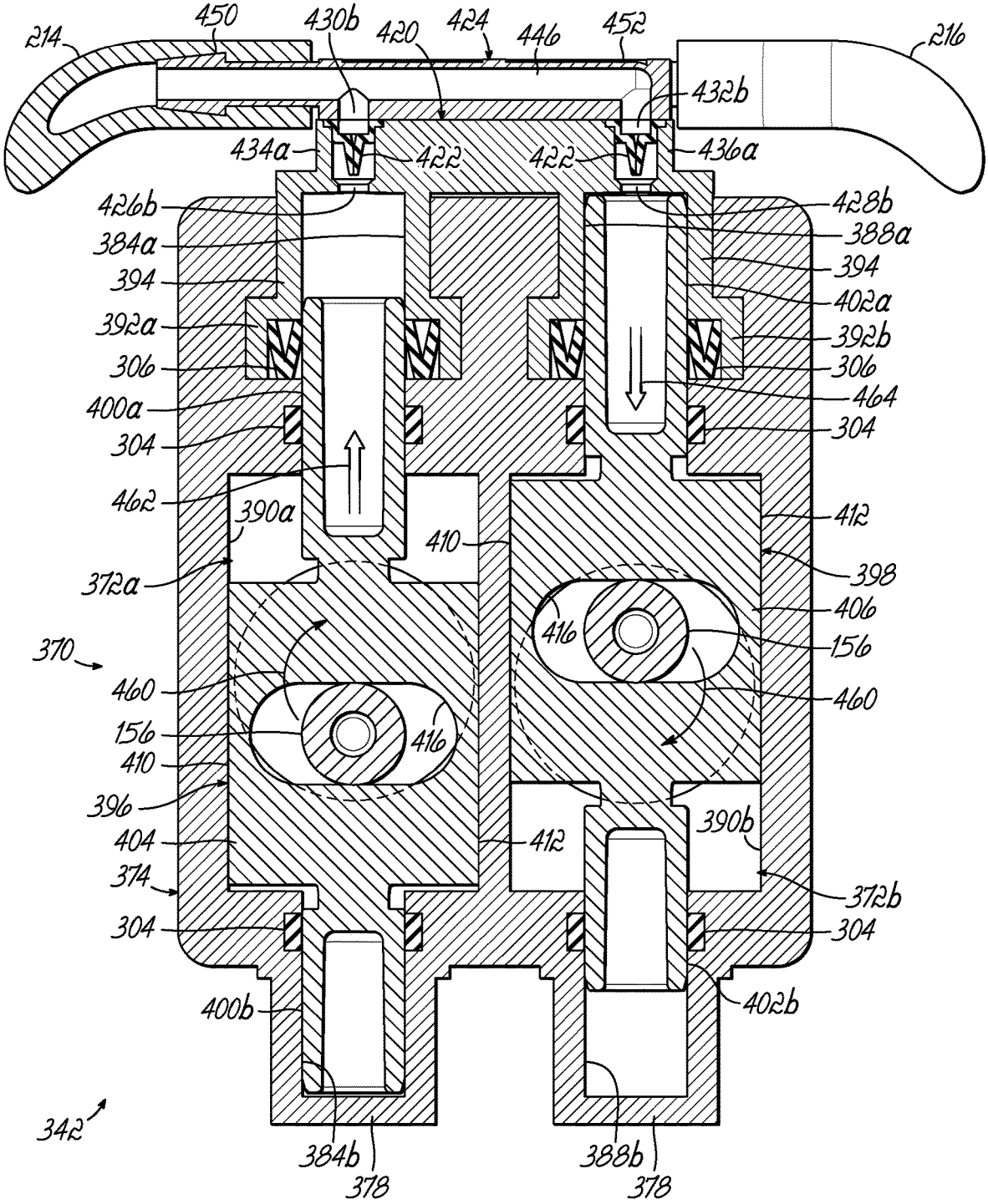
FIG. 16B is another cross-sectional view of the dual-piston pump module illustrating the inflow of chemical product to the pump.
Figure 18B:
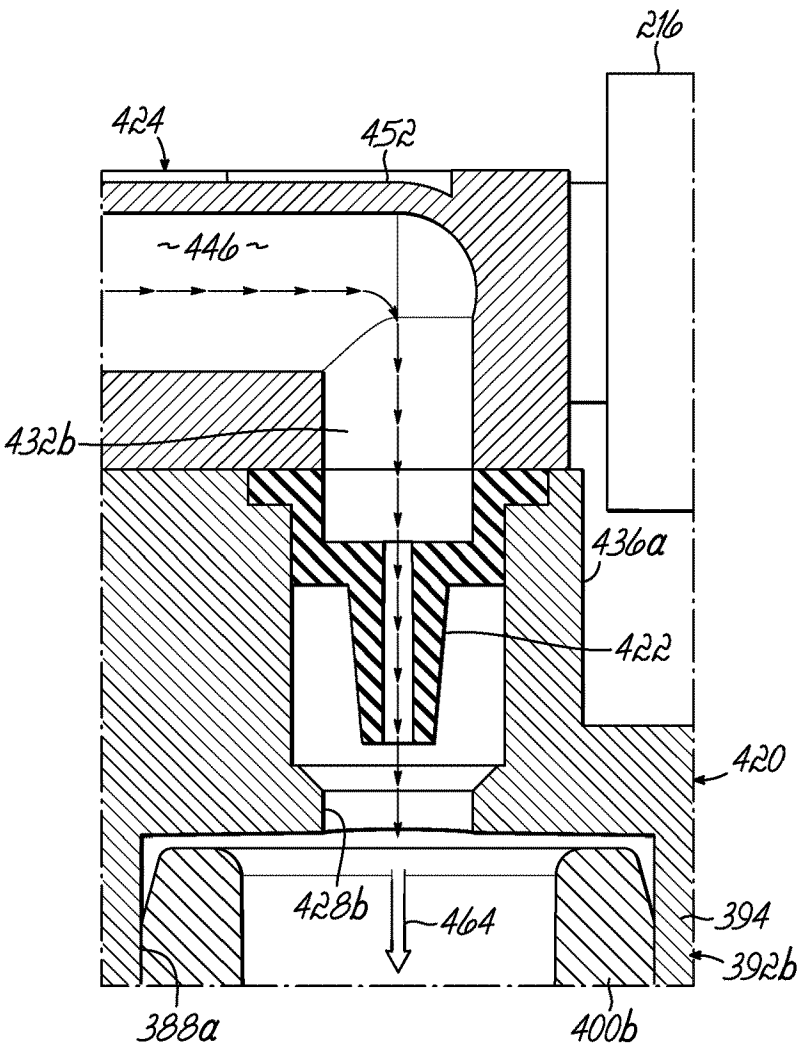
FIG. 18B is another enlarged partial view of the valve arrangement during the inflow of chemical product to the pump.
Figure 18A:
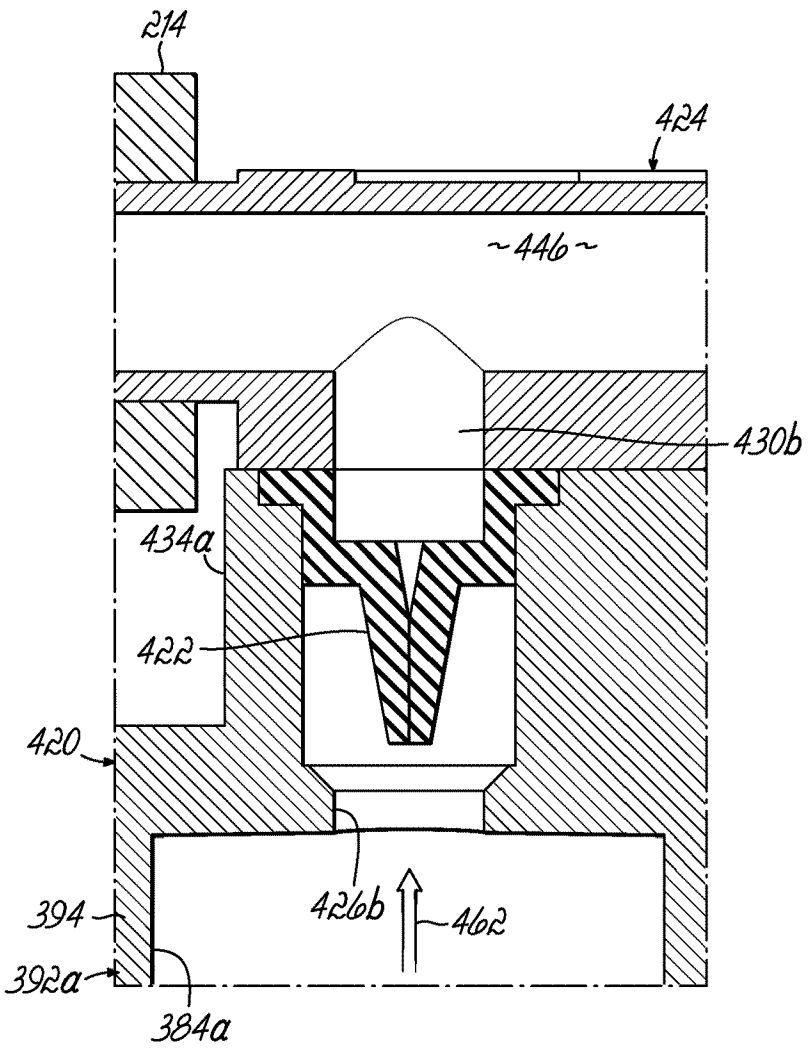
FIG. 18A is an enlarged partial view of the valve assembly during the inflow of chemical product to the pump.

And, with reference to FIGS. 16B, 18A, and 18B, when assembled, the inlet channel 446 is in fluid communication with each of the left cylinder 384*a* and the right cylinder 388*a* through a respective one of the valves 422. Thus, each cylinder 384*a* and 388*a* has associated therewith an inlet port 426*b*, 428*b* and 430*b*, 432*b* for allowing intake of the chemical product into the respective cylinder 384*a* and 388*a* from the inlet channel 446.

Operation of the pump module 340, once coupled to the chemical dispenser 14 and operational within the chemical dispensing system 10, will now be described. FIGS. 16A-21B illustrate operation of the pump module 340 as it relates to inflow and outflow of chemical product from the pump module 340. The initial configuration described of the pump module 340 will be with the left piston 396 in the bottom dead position with the cylinder 384*a* full of product, and the right piston 398 in the top dead position with the cylinder 388*a* discharged. This configuration is shown in FIGS. 16A and 16B with respect to the inlet channel 446 and outlet channel 448, respectively, of the product manifold 424. Although not shown, it will be appreciated that following discharge, each cylinder 384*a*, 388*a* may contain residual product, particularly in the hollow heads 400*a*, 402*a*. Activation of the motor 146 (i.e., under the control of controller 34) causes the primary drive gear 152 to rotate, which in turn causes both the secondary drive gears 154 to rotate (as is indicated by arrows 460). With rotation of the secondary drive gears 154, the left piston 396 begins to move upward (indicated by arrow 462) through a positive pressure stroke (i.e., exhaust) and the right piston 398 begins to move downward (indicated by arrow 464) through a negative pressure stroke (i.e., intake or vacuum).

Focusing first on outlet channel 448, during the positive pressure stroke of the left piston 396 (shown by way of arrow 462), the positive pressure in the cylinder 384*a* causes the valve 422 between the fluid ports 426*a* and 430*a* to open. When opened, fluid in the cylinder 384*a* is permitted to flow into the outlet channel 448. This valve configuration for the left piston 396 is illustrated in FIG. 17A, for example. However, during the negative pressure stroke of the piston 398, the negative pressure in the cylinder 388*a* causes the valve 422 between the fluid ports 428*b* and 432*b* to remain closed. This is shown in FIGS. 16A and 17B, for example. When that valve 422 is closed, fluid is prevented from passing from the outlet channel 448 into the cylinder 388*a*.

Turning now to the inlet channel 446 and FIG. 16B, during the same positive pressure stroke of the left piston 396 (described above and shown by way of arrow 462), the positive pressure in the cylinder 384*a* causes the valve 422 between the fluid ports 426*b* and 430*b* to remain closed. When closed, fluid in the cylinder 384*a* is prevented from flowing into the inlet channel 446. This valve configuration for the left piston 396 at the inlet channel 446 is illustrated in FIG. 18A, for example. However, during the negative pressure stroke of the piston 398, the negative pressure in the cylinder 388*a* causes the valve 422 between the fluid ports 428*b* and 432*b* to open. This is shown in FIGS. 16B and 18B, for example. When that valve 422 is opened, fluid is drawn into the cylinder 388*a* from the inlet channel 446.

Figure 19A:
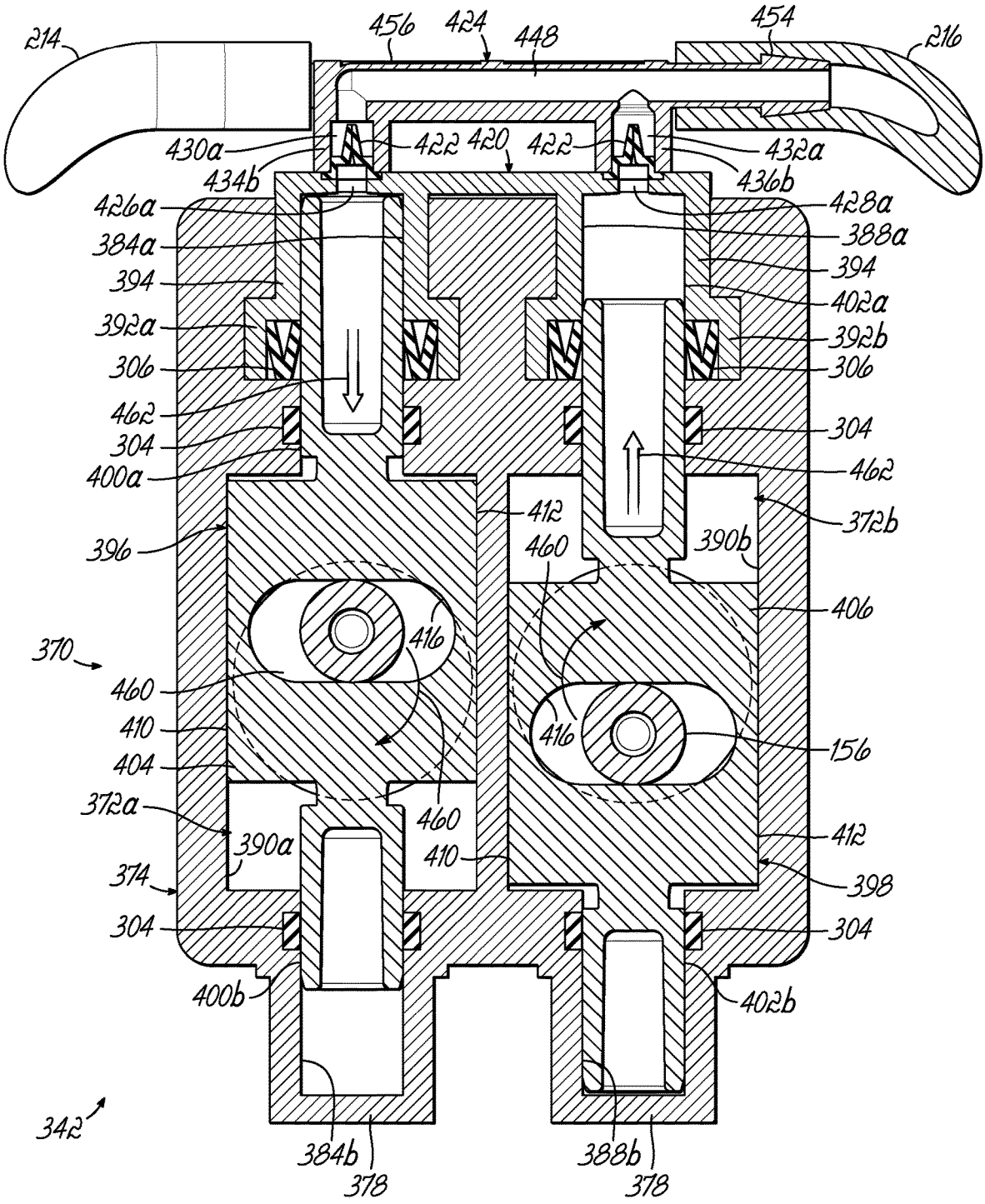
FIG. 19A is a cross-sectional view of the dual-piston pump module illustrating the outflow of chemical product to from pump.
Figure 19B:
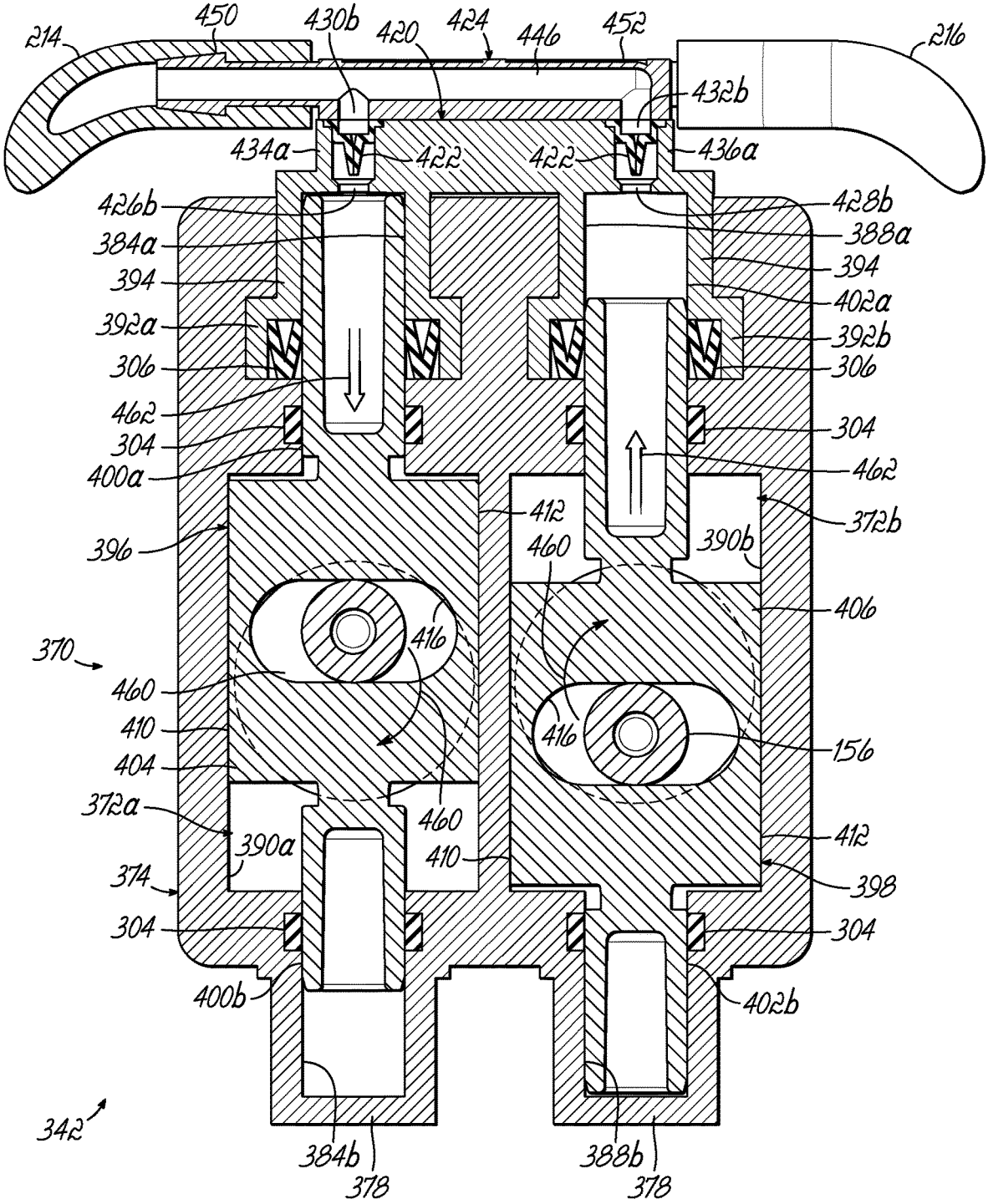
FIG. 19B is another cross-sectional view of the dual-piston pump module illustrating the inflow of chemical product to the pump.

The left piston 396 continues to exhaust chemical product from the cylinder 384*a* to the outlet channel 448 (shown in FIGS. 16A and 17A), and the right piston 398 continues to pull chemical product into the cylinder 388*a* from the inlet channel 446 (shown in FIGS. 16B and 18B) until the left piston 396 and right piston 398 substantially reach their top dead position and bottom dead position, respectively. This configuration of the pump module 340 is shown in FIGS. 19A and 19B. At this point, the pistons 396, 398 change direction with further activation of the motor 146 such that the left piston 396 begins to move downward through a negative pressure stroke and the right piston 398 begins to move upward through a positive pressure stroke.

Figure 20B:
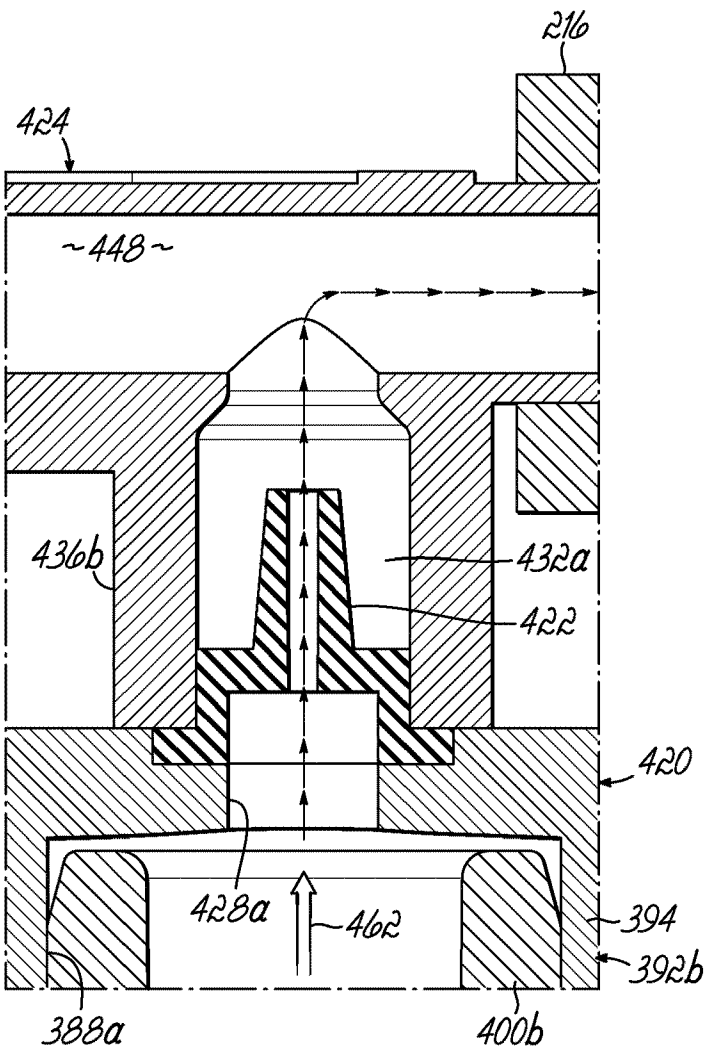
FIG. 20B is another enlarged partial view of the valve arrangement during the outflow of chemical product from the pump.
Figure 20A:
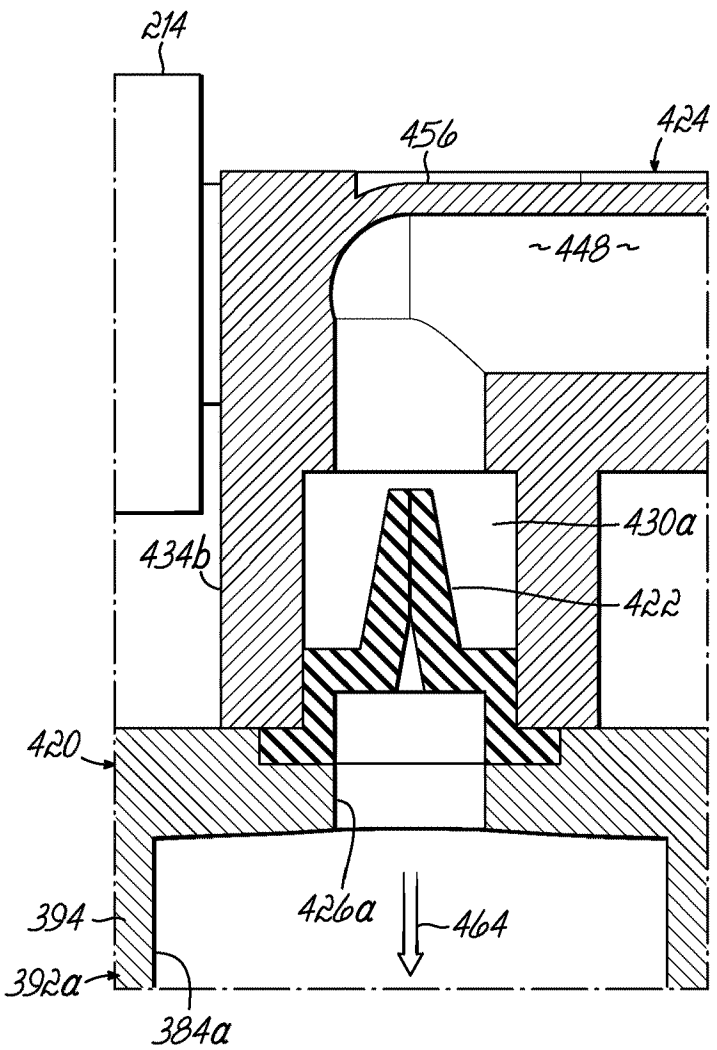
FIG. 20A is an enlarged partial view of the valve assembly during the outflow of chemical product from the pump.

At this position and referring to FIGS. 19A and 20A, which depict a cross section through the outlet channel 448, during the negative pressure stroke of the left piston 396 (shown by way of arrow 464), the negative pressure in the cylinder 384*a* causes the valve 422 between the fluid ports 426*a* and 430*a* to remain closed. When that valve 422 is closed, fluid is prevented from passing from the outlet channel 448 to the cylinder 384*a*. This valve configuration for the right piston 398 is illustrated in FIG. 20A, for example. However, with reference to FIGS. 19A and 20B, the positive pressure in the right cylinder 388*a* causes the valve 422 between the fluid ports 428*b* and 432*b* to open. When that valve 422 is opened, fluid in the cylinder 388*a* is permitted to flow into the outlet channel 448. This valve configuration for the right piston 398 is illustrated in FIG. 20B, for example.

Figure 21B:
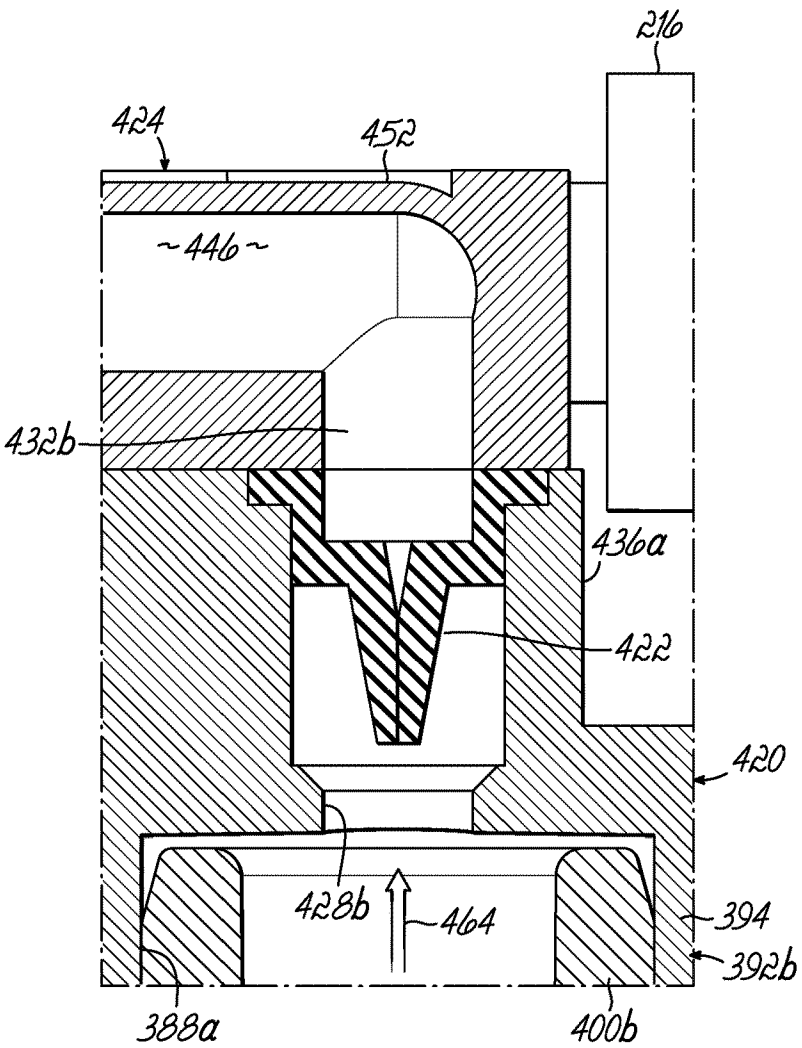
FIG. 21B is another enlarged partial view of the valve arrangement during the inflow of chemical product to the pump.
Figure 21A:
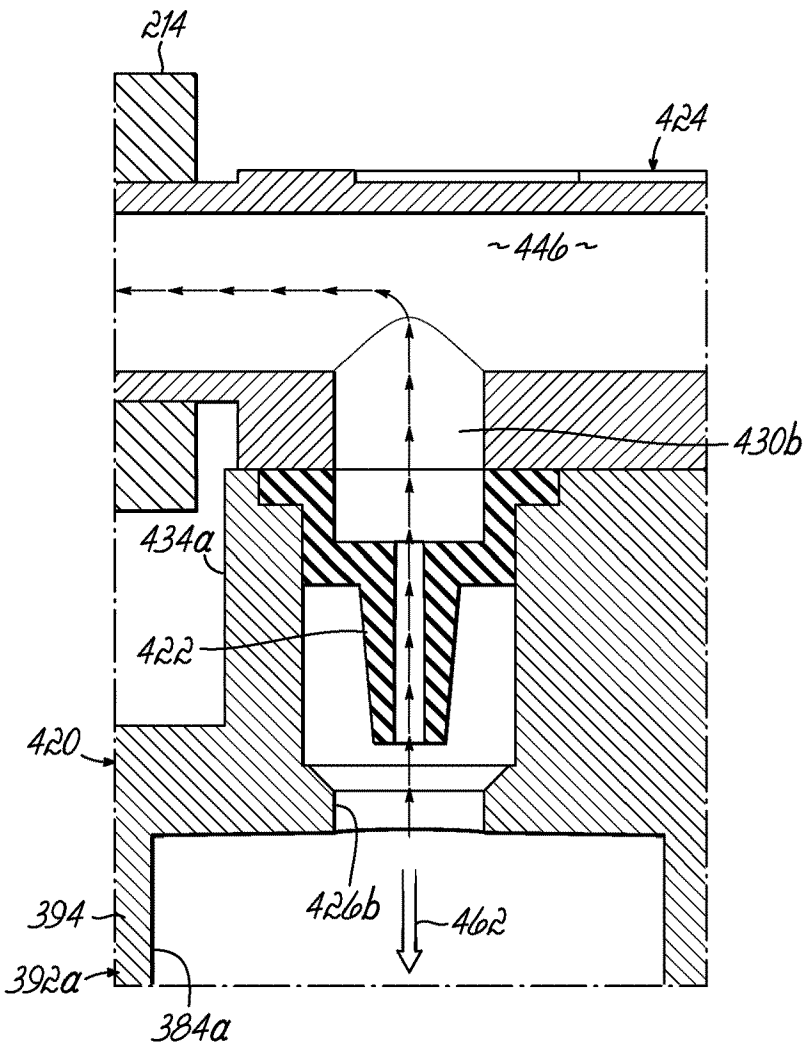
FIG. 21A is an enlarged partial view of the valve assembly during the inflow of chemical product to the pump.

Turning now to the inlet channel 446 and referring to FIGS. 19B and 21B, during the positive pressure stroke of the right piston 398 (shown by way of arrow 462), the positive pressure in the cylinder 388*a* causes the valve 422 between the fluid ports 428*a* and 432*a* to remain closed. When that valve 422 is closed, fluid is prevented from flowing from the cylinder 388*a* to the inlet channel 446. This valve configuration for the left piston 396 is illustrated in FIG. 21B, for example. However, with reference to FIGS. 18B and 21A, the negative pressure in the left cylinder 384*a* causes the valve 422 between the fluid ports 426*b* and 430*b* to open. When that valve 422 is opened, fluid in the inlet channel 446 is permitted to flow into the cylinder 384*a*. This valve configuration for the left piston 396 is illustrated in FIG. 21A, for example.

With reference to FIGS. 19A and 19B, the right piston 398 continues to eject product from the cylinder 388*a* to the outlet channel 448, and the left piston 396 continues to intake product into the cylinder 384*a* from the inlet channel 446 until the left and right pistons 396, 398 substantially reach their bottom dead position and top dead position, respectively. This configuration of the pump module 340 is shown in FIGS. 16A and 16B. At this point, the pistons 396, 398 change direction with further activation of the motor 146 such that the cycle described above repeats itself and product continues to be drawn into the pump module 340 and expelled from the pump module 340 in a substantially continuous and constant fashion.

The dual-piston double-ended arrangement of the pump module 340 provides a number of advantages. For example, it is believed that the valves 422 and the seals (e.g., the O-rings) associated with the pistons 396, 398 will generally have a long operating life such that maintenance on the pump module 340 will be significantly reduced. By way of example, it is believed that the dual-piston pump module 340 may operate around 200% longer than current peristaltic pump designs. This is significant in both costs and down time for the chemical dispensing system. Additionally, the dual-piston arrangement provides a generally constant flow of chemical product from the pump during operation. This is in contrast to many types of pumps which may have generally non-continuous output cycles (e.g., step function output cycles). This may be important because of the amount of time in which to pump a chemical product to the washing machine may be relatively short. Because of the near constant flow of chemical product from the pump module 340, a smaller pump may be utilized for achieving the desired amount of chemical product for delivery to the washing machine.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user.

What is claimed is:

1. A chemical dispenser, comprising:

a housing;

a controller disposed in the housing for operating the chemical dispenser;

at least one module bay in the housing; and at least one module selectively coupled to the at least one module bay and operatively coupled to the controller for operation with the chemical dispenser, wherein the at least one module is selected from a plurality of modules each capable of being coupled to the at least one module bay and operating under the control of the controller; and wherein the at least one module comprises a face plate configured to engage with a support surface of the at least one module bay to secure the at least one module to the housing.

2. The chemical dispenser of claim 1, wherein the housing includes a plurality of module bays, each module bay configured to receive a respective module selected from the plurality of modules.

3. The chemical dispenser of claim 1, wherein at least one of the plurality of modules is a pump.

4. The chemical dispenser of claim 3, wherein more than one of the plurality of modules are pumps.

5. The chemical dispenser of claim 4, wherein the more than one of the plurality of modules include peristaltic pumps, diaphragm pumps, dual-piston pumps, and/or double-ended piston pumps.

6. The chemical dispenser of claim 1, wherein at least one of the plurality of modules is an alarm.

7. The chemical dispenser of claim 6, wherein more than one of the plurality of modules are alarms.

8. The chemical dispenser of claim 7, wherein the more than one of the plurality of modules include visual alarms and/or audio alarms.

9. The chemical dispenser of claim 1, wherein at least one of the plurality of modules is a valve.

10. The chemical dispenser of claim 9, wherein more than one of the plurality of modules are valves.

11. The chemical dispenser of claim 10, wherein the more than one of the plurality of modules include a solenoid valve.

12. A chemical dispensing system comprising:

a chemical dispenser comprising:

a housing;

a controller disposed in the housing for operating the chemical dispenser;

a plurality of module bays in the housing; and a plurality of modules selectively coupled to the plurality of module bays and operatively coupled to the controller for operation with the chemical dispenser, wherein the plurality of modules is selected from a set of modules, each module of the set of modules being capable of being coupled to any module bay of the plurality of module bays and operating under the control of the controller.

13. The chemical dispensing system of claim 12 further comprising:

a washing machine operatively coupled to the chemical dispenser.

14. The chemical dispensing system of claim 12, wherein the set of modules comprises pump modules, valve modules, and alarm modules.

15. The chemical dispensing system of claim 12, wherein one or more of the plurality of modules comprise a pump module, wherein the pump module comprises a peristaltic pump, a diaphragm pump, a dual-piston pump, or a double-ended piston pump.

16. The chemical dispensing system of claim 14, wherein one or more of the plurality of modules comprise an alarm module comprising a visual alarm and/or an audio alarm.

17. The chemical dispenser of claim 1, wherein the at least one module comprises:

an inner portion that extends through an aperture of the at least one module bay into an interior of the housing when the at least one module is coupled to the at least one module bay.

18. A chemical dispenser, comprising:

a housing;

a controller disposed in the housing for operating the chemical dispenser;

at least one module bay in the housing, the at least one module bay comprising a support surface having an aperture open to an interior of the housing; and at least one module selectively coupled to the support surface of the at least one module bay and operatively coupled to the controller for operation with the chemical dispenser, the at least one module comprising an inner portion that extends through the aperture of the at least one module bay into the interior of the housing when the at least one module is coupled to the at least one module bay, wherein the at least one module is selected from a plurality of modules each capable of being coupled to the at least one module bay and operating under the control of the controller.

19. The chemical dispenser of claim 18, wherein the at least one module bay comprises:

a wire harness configured to connect to the inner portion of the at least one module to operatively couple the at least one module to the controller when the at least one module is coupled to the support surface of the at least one module bay.

20. The chemical dispenser of claim 19, wherein the plurality of modules comprises pump modules, valve modules, and alarm modules.

* * * * *